US007425673B2

(12) United States Patent
Fujisaka et al.

(10) Patent No.: US 7,425,673 B2
(45) Date of Patent: Sep. 16, 2008

(54) TONE OUTPUT DEVICE AND INTEGRATED CIRCUIT FOR TONE OUTPUT

(75) Inventors: Kosei Fujisaka, Kyoto (JP); Tetsuro Sugioka, Kyoto (JP); Kazuki Adachi, Kyoto (JP); Kiyomi Kimura, Nara (JP); Tsuyoshi Takayama, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 55 days.

(21) Appl. No.: 11/583,984

(22) Filed: Oct. 20, 2006

(65) Prior Publication Data

US 2007/0101854 A1 May 10, 2007

(30) Foreign Application Priority Data

Oct. 20, 2005 (JP) ..... 2005-305504
Nov. 7, 2005 (JP) ..... 2005-321976
Oct. 16, 2006 (JP) ..... 2006-281358

(51) Int. Cl.
*G10H 7/00* (2006.01)

(52) U.S. Cl. ..... 84/603; 84/604; 84/609; 84/615; 700/94

(58) Field of Classification Search ..... 84/603; 700/94
See application file for complete search history.

(56) References Cited

U.S. PATENT DOCUMENTS 5,691,493 A 11/1997 Usami et al.
6,137,046 A * 10/2000 Kamiya ..... 84/604
6,972,362 B2 * 12/2005 Nakamura ..... 84/603
7,039,477 B1 * 5/2006 Kamiya et al. ..... 700/94
2001/0023634 A1 * 9/2001 Tamura ..... 84/603
2002/0043150 A1 * 4/2002 Okamura et al. ..... 84/603
2002/0158694 A1 * 10/2002 Endo et al. ..... 331/18
2003/0071746 A1 * 4/2003 Koyanagi ..... 341/60
2006/0136682 A1 * 6/2006 Haridas et al. ..... 711/154

FOREIGN PATENT DOCUMENTS

JP 9-198045 A 7/1997

* cited by examiner

*Primary Examiner*—Lincoln Donovan
*Assistant Examiner*—Kawing Chan
(74) *Attorney, Agent, or Firm*—McDermott Will & Emery LLP

(57) ABSTRACT

In a tone output device 100, an oscillator 102 outputs a clock 141 that is emitted by a crystal resonator. A multiplication circuit 103 outputs a clock 142 that is generated by multiplying the clock 141. A timing control circuit 104 outputs a timing signal 150 generated based on the clock 142 for operations of a CPU 105. The CPU 105 operates in sync with the timing signal 150. The DA converter 115 operates in sync with a signal generated based on the clock 141. The timing adjustment circuit 114 detects deviation of the clock 142 from the clock 141 resulting from frequency jitter of the clock 142, and prevents occurrence of clock racing.

4 Claims, 13 Drawing Sheets

TONE OUTPUT DEVICE AND INTEGRATED CIRCUIT FOR TONE OUTPUT

BACKGROUND OF THE INVENTION (1) Field of the Invention

The present invention relates to a tone output device and a tone output integrated circuit for outputting tone signals. More particularly, the present invention relates to a technique of parallel execution of control by CPU and tone signal output.

(2) Description of the Related Art

A tone output device executes tone signal output by a tone output unit, in parallel with a system control by CPU. The system control includes specification of data used for tone signal output. Generally, the tone output unit operates at a relatively low frequency clock that is provided for tone signal playback. On the other hand, the CPU needs to operate at a higher frequency clock than the clock for tone output to make full use of its capabilities.

One technique to address the above need is to provide separate oscillators to generate a clock for the tone output unit and a clock for the CPU. Yet, provision of multiple oscillators involves disadvantages of reducing the packaging density on a semiconductor chip and increasing the manufacturing cost.

In view of the above disadvantages, one technique is suggested in which a single oscillator is employed and different clocks are generated from a clock pulse emitted by the single oscillator and the tone output device and the CPU operate at the respective clocks. This technique is disclosed, for example, in JP patent application publication No. 9-198045

Generally, a clock generating circuit is used to generate clocks of different frequencies than a clock emitted by a single oscillator. Examples of clock generating circuits include a PLL (Phase Locked Loop) and a ring oscillator.

However, a clock generated by a clock generating circuit, such as a PLL, involves a relatively large frequency jitter. Operation of the tone output unit in accordance with a clock generated by such a clock generating circuit inevitably reduces the sound quality of tone output.

SUMMARY OF THE INVENTION

The present invention is made in view of the above problems and aims to provide a tone output device that operates at a single oscillator to output a tone signal without restricting the CPU performance, while suppressing degradation of the sound quality of the tone signal.

In order to achieve the above aim, the present invention provides a tone output device that has internal memory storing tone data and a control program for reading of the tone data, and that reads and converts the tone data into an analog tone signal. The tone output device includes: a clock oscillator operable to generate a reference clock by using a crystal resonator; a multiplication circuit operable to generate a multiplied clock by multiplying the reference clock; a control circuit including an internal buffer and operable to store the tone data from the memory into the buffer and transfer the tone data stored in the buffer, the tone data storing being performed in sync with a signal based on the multiplied clock and the tone data transfer being performed in accordance with predetermined timing; a CPU operable, in sync with a signal based on the multiplied clock, to execute the control program stored in the memory so as to cause the control circuit to perform the tone data transfer; and a DA converter operable, in sync with a clock signal based on the reference clock, to convert the transferred tone data into an analog tone signal and output the analog tone signal.

In another aspect, the present invention provides a tone output integrated circuit that has internal memory storing tone data and a control program for reading of the tone data, and that reads and converts the tone data into an analog tone signal. The integrated circuit includes: a control circuit including an internal buffer and operable to store the tone data from the memory into the buffer and transfer the tone data stored in the buffer; a CPU operable to execute the control program stored in the memory so as to cause the control circuit to perform the tone data transfer; and a DA converter operable to convert the transferred tone data into an analog tone signal and output the analog tone signal.

With the above structure of the tone output device and the tone output integrated circuit according to the present invention, the DA converter outputs a tone signal in sync with a signal that is generated from a reference clock emitted by a crystal resonator and thus involves relatively little frequency jitter. Consequently, sound quality degradation of the output tone signal due to frequency jitter is suppressed.

In addition, the CPU operates in sync with a signal generated based on a multiplied clock. The multiplication circuit generates a multiplied clock of a frequency necessary for the CPU operations. Thus, it is ensured that the CPU operates fully without any limitation imposed on its performance by the operation clock.

Here, the control circuit may include a transfer timing adjustment circuit operable to generate a timing signal based on the reference clock. The predetermined timing of the tone data transfer may be in sync with the timing signal. The tone output device may further include: a deviation detecting circuit operable to issue a reset signal upon detecting that a predetermined reference point of the multiplied clock deviates from a predetermined reference point of the reference clock by a predetermined amount, the reset signal being indicative of the deviation detection. Upon receipt of a reset timing, the transfer timing adjustment circuit is operable to adjust generation of the timing signal so as to provide a predetermined relation between the timing signal and the timing with which the control circuit stores the tone data into the buffer.

With this structure, if a reference portion of the multiplied clock deviates from a reference portion of the reference clock by a predetermined amount or more, the transfer timing adjustment circuit adjusts generation of the timing signal to provide a predetermined relation with the timing with which the control circuit stores tone data into the buffer. Suppose, for example, the tone data stored in the memory is buffered into the control circuit in the predetermined size unit. In this case, the timing signal is so adjusted that the unit data already stored in the buffer is transferred before the next unit data is stored into the buffer. With this arrangement, occurrence of clock racing is prevented and thus degradation in sound quality of tone signal due to clock racing is prevented as well.

The term "reference portion" used herein refers to a predetermined rising or falling edge of the reference clock and the multiplied clock.

Generally, a multiplied clock is generated by a clock generating circuit, such as PLL or ring oscillator. A multiplied clock generated by a clock generating circuit involves larger frequency jitter as compared with a reference clock emitted by a crystal resonator. As a result, there is a risk that a reference portion of the multiplied clock deviates and thus cannot be synchronized with a reference portion of the reference clock.

Here, the control circuit may be operable to transfer each of a plurality of pieces of sampling data constituting the tone data stored in the buffer for a plurality of number of times, so that the tone data stored in the buffer is oversampled.

With this structure, the control circuit transfers each piece of sampling data repeatedly for a plurality of number of times for oversampling. This prevents degradation of sound quality of the output tone signal.

Here, the tone output device may further include: a data bus that is connected to each of the memory, the control circuit, and the CPU, and via which the tone data is transferred to the control circuit and the control program is transferred to the CPU. The control by the CPU may include arbitration of a right to use the data bus. The control circuit may include: a read adjustment circuit operable, under control by the CPU, to issue a read permission signal upon being granted the right to use the data bus; an output instruction circuit operable to perform an output instruction process upon receipt of a read permission signal, the output instruction process including outputting of an address on the memory at which the tone data is stored and of a read signal that instructs output of the tone data stored at the address; a first data control circuit operable, upon receipt of a read permission signal, to (i) store the tone data that is output to the data bus into the buffer being a first buffer and (ii) transfer the tone data stored in the first buffer when necessary; and a second data control circuit having a second buffer that is different from the first buffer and operable to (i) store the tone data transferred from the first data control circuit into the second buffer and (ii) transfer the tone data stored in the second buffer to the DA converter in sync with a sampling interval. Upon receipt of a read signal from the output instruction circuit, the memory may be operable to output the tone data stored at the address to the data bus.

With this structure, each of the first and second data control circuits has a buffer. The tone data fed to the data bus is transferred to the DA converter sequentially via the first data control circuit and the second data control circuit. Accordingly, the second data control circuit is enabled to transfer tone data at a constant interval in sync with the sampling interval, even if the read adjustment circuit is not granted the bus-use right at a constant interval. As a consequence, waveform distortion at the time of tone data playback is reduced.

Here, the tone output device may further include: a data bus that is connected to the memory, the control circuit, and the CPU, and via which the tone data is transferred to the control circuit and the control program is transferred to the CPU. The control by the CPU may include arbitration of a right to use the data bus. The control circuit may include: a read adjustment circuit operable, under control by the CPU, to issue a read permission signal upon being granted the right to use the data bus; an output instruction circuit operable to perform an output instruction process upon receipt of a read permission signal, the output instruction process including outputting of an address on the memory at which the tone data is stored and of a read signal that instructs output of the tone data stored at the address; and a data control circuit operable, upon receipt of a read permission signal, to (i) perform a storing process of storing the tone data that is output to the data bus into the buffer and (ii) transfer the tone data stored in the buffer to the DA converter. Upon receipt of the read signal from the output instruction circuit, the memory may be operable to output the tone data stored at the address to the data bus.

With this structure, upon grant of the bus-use right to the read adjustment circuit under control by the CPU, the data control circuit stores tone data fed to the data bus into the buffer. Thus, even if single memory is used to store tone data as well as a control program that is used for executing reading control of the tone data, the tone data is appropriately read from the memory, without any contention between the data control circuit and the CPU for accessing the data bus.

Here, when the read adjustment circuit is granted the right to use the data bus and issues a read permission signal, the output instruction circuit may be operable to (i) perform the output instruction process for a plurality of times for each read permission signal received and (ii) perform the storing process for a plurality of times for each read permission signal received.

With this structure, each time the read adjustment circuit is granted the bus-use right, the data control circuit performs the storing process for a plurality of times in succession. Thus, the bus-use right arbitration is required for a smaller number of times for performing the storing process for the same number of times. This ensures effective use of the data bus.

Note that the bus-use right is granted after arbitration between the CPU and the read adjustment circuit. That is, during the time of bus-use right arbitration, neither the CPU nor the data control circuit can use the data bus.

Here, the tone data may be composed of a plurality of pieces of sampling data each of which is compressed at a predetermined compression rate. The buffer included in the data control circuit may be composed of a first buffer area for storing the tone data that is output from the data bus and a second buffer area for saving tone data. The tone output device may further include: a compression rate switching register operable to (i) store a size of each piece of compressed sampling data and (ii) issue a compression rate signal indicative of the data size to the data control circuit. The data control circuit may be operable to transfer, sequentially in units of the data size indicated by the compression rate signal, the tone data stored in the first buffer area. If tone data smaller than the data size indicated by the compression rate signal remains in the first buffer area as a result of the tone data transfer, the data control circuit may be operable to (i) store the remaining tone data into the second buffer area and (ii) transfer the remaining tone data with a portion of tone data newly stored into the first buffer area, the remaining tone data and the portion of newly stored data amounting to the data size indicated by the compression rate signal.

With this structure, the data control circuit appropriately operates even in the case where the size of tone data that is stored into the first buffer area at a time is not equal to an integral multiple of the size of tone data that is transferred at a time. If tone data that is smaller than the transfer size remains in the buffer, the remaining data is saved. When tone data is newly stored into the buffer, a portion of the newly stored tone data is added to the saved data so as to be equal in size to the transfer size. The resulting data is then transferred to the DA converter. This arrangement ensures that tone data is correctly output to the DA converter.

Here, the tone data may be composed of a plurality of pieces of phrase data that are compressed at different compression rates and each piece of phrase data may be composed of a plurality of pieces of sampling data. The tone output device may further include: a compression rate switching control circuit operable to (i) store, for each piece of phrase data, a size of each piece of compressed sampling data included in the respective piece of phrase data, and (ii) issue a compression rate signal indicative of the data size for a piece of phrase data that is currently stored in the buffer to the data control circuit. The data control circuit may be operable to transfer, sequentially in units of the data size indicated by the compression rate signal, the phrase data stored in the buffer.

With this structure, even if tone data is composed of a plurality of pieces of phrase data that are compressed at different compression rates, the data control circuit sequentially transfers tone data portion by portion in unit size that is determined accordingly to the compression rate of a corresponding pieces of phrase data. This ensures that tone data is correctly output to the DA converter, even if the tone data is compressed phrase by phrase at different compression rates.

Here, a size of the tone data may not be an integral multiple of a width of the data bus. The tone output device may further include: an end control circuit including a counter circuit, and operable to (i) store the tone data size and a transfer size of tone data that the data control circuit transfers at a time, and (ii) issue an end detection signal to the data control circuit when a value of the counter reaches the size of the tone data. The data control circuit may be operable to (i) transfer tone data stored in the buffer until an end detection signal is received, the data output signal being indicative of the tone data transfer, and (ii) issue a data output signal to the end control circuit for each tone data transfer. Each time a data output signal is received, the end control circuit may be operable to increment the counter value by the transfer size.

With this structure, at the time when the data control circuit completes transfer of data that is equal in size to the tone data size, the end control circuit issues an end detention signal to the data control circuit. In response, the data control circuit suspends data transfer to the DA converter. Consequently, even in the case where the size of tone data is not equal to an integral multiple of the width of the data bus, it is prevented that data other than the tone data remaining in the buffer is transferred to the DA converter.

Here, a size of tone data that the buffer included in the data control circuit stores at a time may be equal to a size of an area of the memory corresponding to two addresses. The tone output device may further include: an end control circuit operable to (i) store a size of the tone data and the two-address memory size, (ii) divide the tone data size by the two-address memory size, and (iii) issue an end detection signal to the data control circuit when a remainder of the division is not equal to zero. Upon receipt of an end detection signal, the data control circuit may be operable to output tone data that is most recently stored into the buffer and that has a size of an area of the memory corresponding to one address.

With this arrangement, in the case where the size of tone data that the data control circuit stores into the buffer at a time is equal to two-address size of the memory, the end control circuit judges whether the tone data is worth an odd number addresses with reference to the tone data size and the one address size. If the tone data is worth an odd number addresses, the end control circuit issues an end detection signal to the data control circuit. Upon receipt of an end detection signal, the data control circuit transfers the buffered data for the amount equal to the one address size, so that the last portion of buffered tone data is transferred. With this arrangement, it is prevented that data other than the tone data remaining in the buffer is transferred to the DA converter.

Here, the tone output device may further include: a data transfer circuit operable to store tone data acquired from an external source into an area of the memory sequentially from a predetermined start address to a predetermined end address. The output instruction circuit may be operable to (i) sequentially output addresses starting from the start address, (ii) issue a storage permission signal to the data transfer circuit upon outputting a predetermined address that is prior to the end address, and (iii) repeat after outputting the end address the sequential output of the addresses starting from the start address. Upon receipt of a storage permission signal, the data transfer circuit is operable to store the tone data into the area of the memory sequentially from the predetermined start address to the end address.

With this arrangement, the output instructing circuit issues a storage permission signal to the data transfer circuit when outputting the address that is, for example, one address before the end address. With this arrangement, when there is not much tone data left in the memory that the data control circuit does not stored into the buffer yet, the data transfer circuit newly acquires additional tone data from the external source and stores the newly acquired tone data into the memory. Thus, the tone output device is capable of outputting, without interruption, any length of tone data exceeding the memory capacity.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes a tone output device according to embodiments of the present invention.

Embodiment 1

<Overview>

A tone output device according to an embodiment 1 of the present invention has memory that stores one or more control programs and control program etc. (hereinafter, collectively referred to as "control program etc.") for use by a CPU and also stores tone data for use by a data control circuit. The tone output device arbitrates bus-use right with the CPU to read tone data from the memory, and performs digital-to-analog conversion of the read tone data to output tone signals.

A DA converter of the tone output device operates at a clock generated by dividing a reference clock that is emitted by a crystal resonator. The CPU of the tone output device operates at one of a plurality of clocks of different frequencies that are generated suitably for respective circuits from a clock that is generated by multiplying the reference clock.

The clock at which the DA converter operates is generated by dividing the reference clock that is emitted by the crystal resonator and thus involves little frequency jitter. This ensures to prevent sound quality degradation of the tone signal output. In addition, the CPU operates at the clocks of suitable frequencies that are generated from the multiplied clock, rather than at the relatively slow clock that is used for tone signal playback. Thus, it is ensured that the CPU operates fully without any limitation on its performance.

In addition, the multiplied clock is generated using a multiplication circuit (PLL). Thus, the multiplied clock inevitably involve higher frequency jitter as compared with the reference clock emitted directly by the crystal resonator. Thus, there is a risk that a reference portion in the multiplied clock pulses but deviates from a reference portion in the reference clock pulses.

In view of the above, the tone output device judges, using a deviation monitoring signal generated from the reference clock and a mask signal generated from the multiplied clock, whether a reference portion in the multiplied clock deviates from a reference portion in the reference clock by a predetermined amount or more. If there is such a deviation, adjustment is made as to the timing of fetching tone data and outputting the fetched tone date to the DA converter. Note that details of the deviation monitoring signal and the mask signal will be given later.

The above arrangement prevents occurrence of clock racing and ensures that tone data stored in the memory is fed to the DA converter with appropriate timing. Consequently, a tone signal is output without loss of sound quality.

<Structure>

Figure 1:
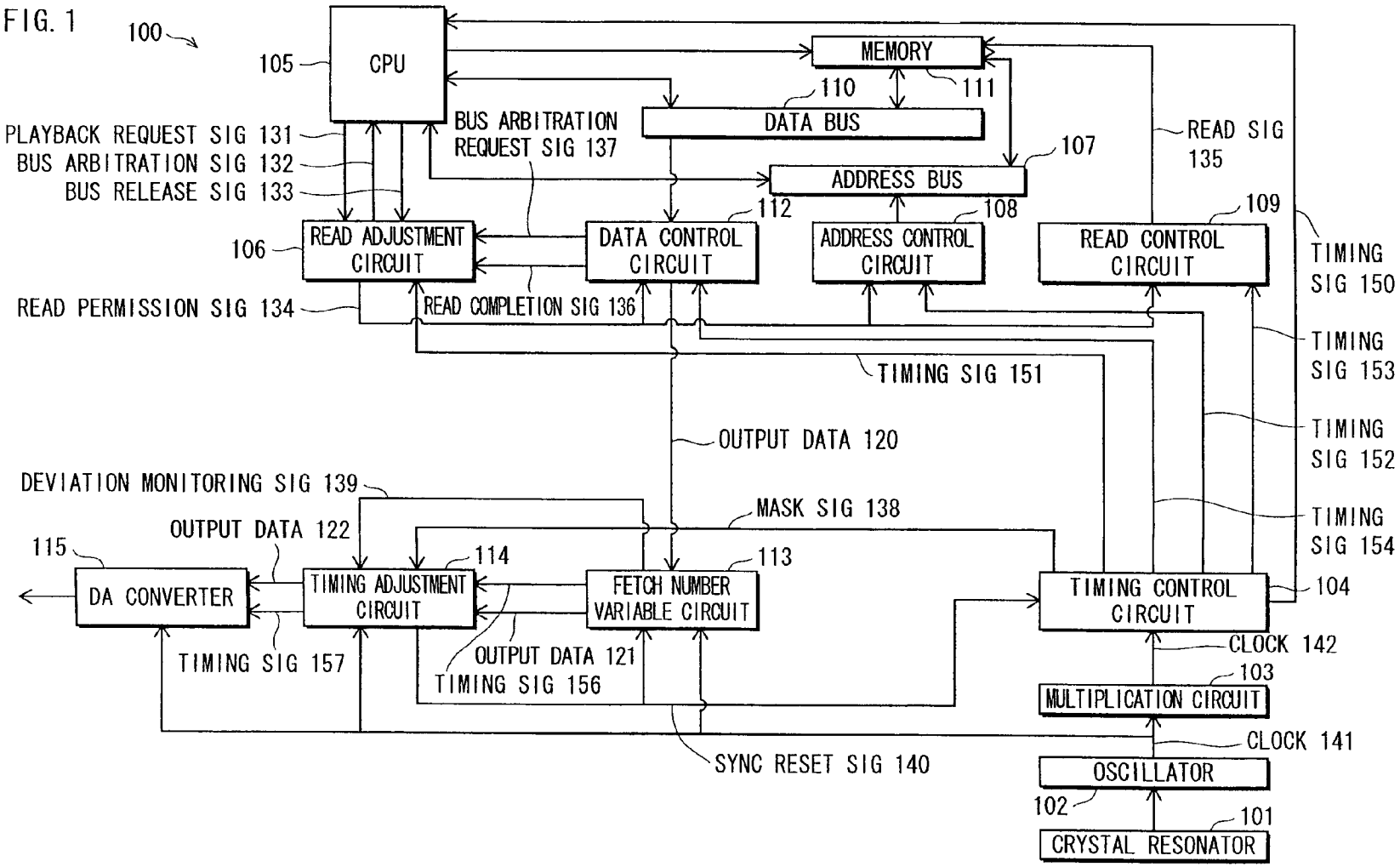
FIG. 1 is a block diagram of a tone output device 100 according to an embodiment 1 of the present invention.

FIG. 1 is a block diagram of a tone output device 100 according to the embodiment 1 of the present invention.

As illustrated in FIG. 1, the tone output device 100 is composed of a crystal resonator 101, an oscillator 102, a multiplication circuit 103, a timing control circuit 104, a CPU 105, a read adjustment circuit 106, an address bus 107, an address control circuit 108, a read control circuit 109, a data bus 110, a memory 111, a data control circuit 112, a fetch number variable circuit 113, a timing adjustment circuit 114, and a DA converter 115.

The crystal resonator 101 is a normal crystal resonator. The oscillator 102 is an oscillator circuit having the crystal resonator 101 and outputs a clock 141. The clock 141 is used as a reference clock for the multiplication circuit 103 and determines the operation timing of the DA converter 115. In addition, the fetch number variable circuit 113 generates a later-described deviation monitoring signal 139 based on the clock 141.

The multiplication circuit 103 is a clock generating circuit for generating a clock at a frequency that is an integral multiple of the frequency of the clock 141 received from the oscillator 102. The clock 142 that is output from the multiplication circuit 103 is used as a reference clock for the timing control circuit 104.

The timing control circuit 104 generates timing signals 150-154 based on the clock 142 that is received from the multiplication circuit 103. The timing signals 150-154 output to the respective circuits and determine the operation timing of the respective circuits.

In addition, the timing control circuit 104 generates a mask signal 138. The mask signal 138 is output to the timing adjustment circuit 114 and used in a later-described deviation detection process. Upon detecting a deviation between a reference portion of the clock 141 and a reference portion of the clock 142, the timing adjustment circuit 114 issues a synchronous reset signal 140. Upon receipt of the synchronous reset signal 140, the timing control circuit 104 resets the timing with which the mask signal 138 is asserted, so that a reference portion of the clock 142 is brought back into synchronism with a reference portion the clock 141 (hereinafter, this state is referred to as the "initial state").

The following briefly describes signals generated by the timing control circuit 104.

The timing signal 150 is used as an operation clock of the CPU 105. The timing signal 151 determines the operation timing of the read adjustment circuit 106. The frequency of the timing signal 150 is equal to the frequency of the timing signal 151 and is sufficiently higher than the sampling frequency. Suppose, for example, that the sampling frequency is 10 KHz, the frequency of the timing signals 150 and 151 is on the order of several MHz.

The timing signal 152 determines the operation timing of the address control circuit 108. The timing signal 153 determines the operation timing of the read control circuit 109. The frequency of the timing signal 152 is equal to the frequency of the timing signal 153 and is an integral multiple of the sampling frequency.

The timing signal 154 determines the operation timing of the data control circuit 112. The frequency of the timing signal 154 is equal to the sampling frequency.

The mask signal 138 is asserted for a predetermined duration at the sampling interval. The mask signal 138 is output to the timing adjustment circuit 114 and used in the later-described deviation detection process by the timing adjustment circuit 114. Note that each non-asserted portion of the mask signal 138 is referred to as a reference portion of the mask signal 138.

The clock 142 involves relatively large frequency jitter as compared with the clock 141 emitted by the crystal resonator. Thus, it is possible that the assertion timing of the mask signal 138 generated from the clock 142 deviates.

The CPU 105 operates using the timing signal 150 received from the timing control circuit 104 as the operation clock. In accordance with a control program stored in the memory 111, the CPU 105 controls the overall system and also effects control of tone data reading. The control of tone data reading includes setting of initial parameters, instructing output start of tone signals, and arbitration of bus-use right.

The control of tone data reading is described more specifically by way of the following example. When playback of tone signals is requested during the time the CPU 105 is executing the system control, the CPU 105 sets the following initial parameters. That is, the address control circuit 108 is set to the address value specifying an area of the memory 111 in which a requested piece of tone data is stored. In addition, the data control circuit 112 is set to the size of tone data that is output at a time (i.e., the size of sampling data). The CPU 105 then sends, to the read adjustment circuit 106, a playback request signal 131 requesting tone signal output.

In addition, upon receipt of a later-described bus arbitration signal 132 from the read adjustment circuit 106, the CPU 105 arbitrates the bus-use right by releasing each bus at the timing not causing any trouble to the system control being executed.

The read adjustment circuit 106 outputs, to the CPU 105, the bus arbitration signal 132 in sync with the timing signal 151 received from the timing control circuit 104. When the CPU 105 releases the bus, the read adjustment circuit 106 outputs a read permission signal 134 to the address control circuit 108, the read control circuit 109, and the data control circuit 112. The read permission signal 134 instructs the respective circuits to read tone data.

The address bus 107 is used by the CPU 105 to specify, to the memory 111, the address value of a memory area in which a desired piece of control program etc. is stored. The address bus 107 is also used by the address control circuit 108 to specify, to the memory 111, the address value of a memory area in which a desired piece of tone data is stored.

The address control circuit 108 outputs, to the address bus 107, the address values specifying an area of the memory 111 in which a requested piece of tone data is stored.

More specifically, upon receipt of a read permission signal 134 from the read adjustment circuit 106, the address control circuit 108 sequentially outputs, to the address bus 107, address values from the start address to the end address of an area of the memory ill in which a requested piece of tone data is stored. The address values a reset in advance by the CPU 105 to the internal register of the address control circuit 108. Note, in addition, that the address values are sequentially output in sync with the timing signal 152 that is received from the timing control circuit 104.

In the case where the requested piece of tone data is stored in a contiguous area of the memory 111, one pair of start and end addresses are set to the internal register. In the case where the requested piece of tone data is stored in a plurality of non-contiguous areas, a plurality of pairs of start and end addresses are set to the internal register.

Upon receipt of a read permission signal 134 from the read adjustment circuit 106, the read control circuit 109 outputs a read signal 135 to the memory 111 in sync with the timing signal 153 received from the timing control circuit 104. The read signal 135 is a signal requesting the memory 111 to feed data to the data bus 110.

The data bus 110 is used to feed control program etc. or tone data that is stored in the memory 111 at the address specified by the address bus 107. Via the data bus 110, the CPU 105 receives control program etc. stored in the memory 111, whereas the data control circuit 112 receives tone data from the memory 111.

The memory 111 is non-volatile memory that stores control program etc. used by the CPU 105 and also stores tone data at arbitrary addresses.

Upon receipt of a read signal 135 from the read control circuit 109, the memory 111 outputs tone data that is stored at the address specified by the address value fed to the address bus 107. The tone data output from the memory 111 is fed to the data bus 110.

The data control circuit 112 includes an internal buffer for storing tone data that is output from the memory 111 via the data bus 110 in sync with the timing signal 154 received from the timing control circuit 104. The data control circuit 112 outputs the buffered tone data to the fetch number variable circuit 113. Here, the buffered tone data is sequentially output in units each having the size (sampling data size) set in advance by the CPU 105 to the internal register.

The fetch number variable circuit 113 generates a timing signal 155 (See FIG. 3) from the clock 141 that is emitted by the crystal resonator. The timing signal 155 is asserted at each sampling interval. The fetch number variable circuit 113 includes an internal buffer for storing tone data that is output in sync with the timing signal 155 from the data control circuit 112. The fetch number variable circuit 113 outputs the buffered tone data to the timing adjustment circuit 114 repeatedly for the predetermined number of oversampling times. Each output of the buffered data is performed in sync with a timing signal 156 generated by the internal clock of the fetch number variable circuit 113. The timing signal 156 includes as many clock pulses as the number of oversampling times at the interval at which the timing signal 155 is asserted (at the interval equal to the sampling interval).

Here, it needs to be ensured that the fetch number variable circuit 113 does not store any tone data that is output from the data control circuit 112 during a changeover between two different pieces of tone data. This is because that tone data during a changeover is not stable and will results in sound quality degradation.

For this reason, it is required that the timing signal 155 be asserted a predetermined time period after a changeover between difference pieces of tone data output from the data control circuit 112. The predetermined relation described above is established between the timing signal 155 and the timing of tone data output by the data control circuit 112.

In addition the fetch number variable circuit 113 generates a deviation monitoring signal 139 based on the clock 141 that is emitted by the crystal resonator and outputs the deviation monitoring signal 139 to the timing adjustment circuit 114. The deviation monitoring signal 139 is asserted at each sampling interval and used in the later-described deviation detection process performed by the timing adjustment circuit 114. Note that each asserted portion of the deviation monitoring signal 139 is referred to as a reference portion of the deviation monitoring signal 139. At the initial state, each reference portion of the deviation monitoring signal 139 falls within a portion corresponding to a reference portion of the mask signal 138.

The timing adjustment circuit 114 issues a synchronous reset signal 140 upon detecting that a reference portion of the clock 142 is deviated from a reference portion of the clock 141. Upon receipt of the a synchronous reset signal 140 from the timing adjustment circuit 114, the fetch number variable circuit 113 adjusts output timing of the timing signal 155, so that the timing signal 155 does not coincide with the timing of a changeover between different pieces of tone data that are output from the data control circuit 112. In addition, the timing adjustment circuit 114 adjusts output timing of the timing signal 156 in agreement with the timing signal 155.

In addition, upon receipt of a synchronous reset signal 140 from the timing adjustment circuit 114, the fetch number variable circuit 113 resets the assertion timing of the deviation monitoring signal 139 to the initial state.

The timing adjustment circuit 114 transfers tone data received from the fetch number variable circuit 113 to the DA converter 115. In addition, the timing adjustment circuit 114 detects a deviation of a reference portion in the clock 142 that is generated by multiplying the clock 141 from a reference portion of the clock 141 that is emitted by the crystal resonator. The deviation detection is performed using the deviation monitoring signal 139 received from the fetch number variable circuit 113 and the mask signal 138 received from the timing control circuit 104.

Upon detecting that a reference portion of the deviation monitoring signal 139 deviates from a reference portion of the mask signal 138 and thus a reference portion of the clock 142 deviates from a reference portion of the clock 141 by a predetermined amount or more, the timing adjustment circuit 114 issues a synchronous reset signal 140 to the timing control circuit 104 and the fetch number variable circuit 113. The synchronous reset signal 140 indicates that deviation is detected.

Note that each reference portion of the mask signal 138 has a predetermined width. Consequently, the timing adjustment circuit 114 accommodates a deviation as long as a reference portion of the deviation monitoring signal 139 falls within a reference portion of the mask signal 138. The width of each reference portion of the mask signal 138 is determined to prevent occurrence of the clock racing. This is because such deviation that falls within a reference portion of the mask signal 138 will not cause a substantial influence.

Similarly to any general DA converter, the DA converter 115 converts digital data into an analog signal and outputs the resulting analog signal. The DA converter 115 receives tone data from the timing adjustment circuit 114 in sync with the timing signal 157 that is received from the timing adjustment circuit 114. The DA converter 115 then interpolates the received tone data, converts the resulting tone data into an analog tone signal, and outputs the analog signal in sync with a clock generated by dividing the clock 141 that is received from the oscillator 102.

<Operations for Bus-Use Right Arbitration and Tone Data Reading>

The following describes operations of the tone output device 100 having the above structure. More specifically, the following describes operations performed for bus-use right arbitration between the CPU 105 and the read adjustment circuit 106. The following also describes operations performed by the data control circuit 112 for reading tone data stored in the memory 111 into the buffer via the data bus 110, and then outputting, as output data 120, the buffered tone data to the fetch number variable circuit 113.

In the following description, it is supposed that tone data is stored in one contiguous area of the memory 111. In addition, the size of tone data that the data control circuit 112 stores into the buffer at a time is equal to the size of tone data that the data control circuit 112 outputs from the buffer to the fetch number variable circuit 113 at a time. In addition, each of the above-mentioned sizes is equal to the size of a single address area of the memory 111.

<Bus-Use Right Arbitration>

Upon a request for playback of tone data, the CPU 105 sets the address control circuit 108 to the start address and the end address of an area of the memory 111 where the requested piece of tone data is stored. In addition, the CPU 105 sets the data control circuit 112 to the output size of tone data that the data control circuit 112 outputs from the internal buffer to the fetch number variable circuit 113 at a time.

The CPU 105 outputs a playback request signal 131 to the read adjustment circuit 106 in sync with the timing signal 150 received from the timing control circuit 104.

Upon receipt of a playback request signal 131 from the CPU 105, the read adjustment circuit 106 outputs a bus arbitration signal 132 to the CPU 105 in sync with the timing signal 151 received from the timing control circuit 104.

Upon receipt of a bus arbitration signal 132 from the read adjustment circuit 106, the CPU 105 releases the bus with appropriate timing not causing any trouble to the control currently being executed. Upon releasing the bus, the CPU 105 issues a bus release signal 133 to the read adjustment circuit 106 in sync with the timing signal 150 received from the timing control circuit 104.

<Tone Data Reading>

Upon receipt of a bus release signal 133 from the CPU 105, the read adjustment circuit 106 issues a read permission signal 134 to the address control circuit 108, the read control circuit 109, and the data control circuit 112.

Upon receipt of a read permission signal 134, the address control circuit 108 sequentially outputs the address values set by the CPU 105 to the address bus 107. Each of the address values is output in sync with the timing signal 152 received from the timing control circuit 104.

Upon receipt of a read permission signal 134, the read control circuit 109 issues a read signal 135 to the memory 111 in sync with the timing signal 153 that is received from the timing control circuit 104.

Upon receipt of a read signal 135, the memory 111 sequentially acquires the address values that are sequentially fed by the address control circuit 108 to the address bus 107. Upon acquisition of each address value, the memory 111 outputs the tone data stored at the acquired address value to the data bus 110.

The data control circuit 112 stores, into the buffer, tone data that is output to the data bus 110 from the memory 111. The tone data is stored in sync with the timing signal 154 that is received from the timing control circuit 104. Then, the data control circuit 112 issues a read completion signal 136 to the read adjustment circuit 106.

Upon receipt of a read completion signal 136, the read adjustment circuit 106 releases the bus.

In addition, the data control circuit 112 sequentially outputs the buffered tone data to the fetch number variable circuit 113 in units each having the set data size. As described above, this data size is set by the CPU 105 as the amount of tone data to be output at a time. The data control circuit 112 then issues a bus arbitration request signal 137 to the read adjustment circuit 106 in sync with the timing signal 154 that is received from the timing control circuit 104.

The above sequence of operations is repeated, so that entirety of the requested piece of tone data is fed from the memory 111 to the fetch number variable circuit 113.

<Description with Reference to Timing Chart>

Figure 2:
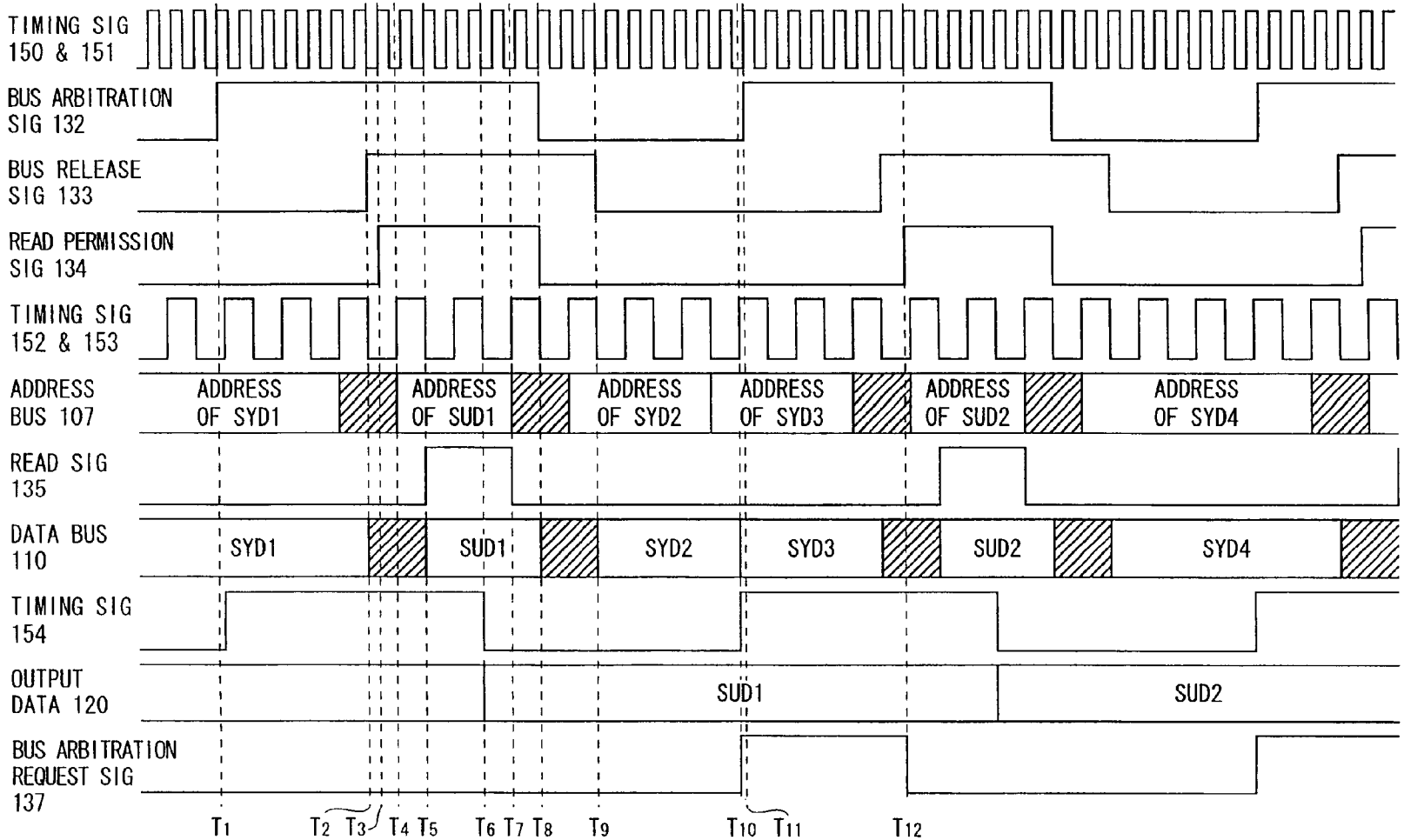
FIG. 2 is a timing chart of operations performed by the tone output device 100 for bus-use right arbitration and tone data reading.

The above sequence of operations is now described with reference to the timing chart illustrated in FIG. 2.

In the following description, the reference numerals "SYD1", "SYD2", "SYD3", and "SYD4" refer to pieces of control program etc. read by the CPU 105, whereas the reference numerals "SUD1" and "SUD2" refer to pieces of tone data. Note that the pieces of control program etc. vary in size depending on the types of control executed by the CPU 105.

In the figure, the reference numeral "T1" denotes a time of the first rising edge of the timing signal 151 after the read adjustment circuit 106 receives a playback request signal 131 (not illustrated) from the CPU 105. At the time "T1", the read adjustment circuit 106 issues a bus arbitration signal 132 to the CPU 105.

The reference numeral "T2" denotes a time at which the CPU 105 is ready to release the data bus for the first time after receiving the bus arbitration signal 132 from the read adjustment circuit 106. Thus, the CPU 105 issues a bus release signal 133 to the read adjustment circuit 106. The CPU 105 releases the bus with the timing not causing any problem to the control being executed. Thus, the amount of time between the time "T1" and "T2" differs depending on the contents of control program etc. read into the CPU 105.

The reference numeral "T3" denotes a time of the first rising edge of the timing signal 151 after the read adjustment circuit 106 receives the bus release signal 133 from the CPU 105. At the time "T3", the read adjustment circuit 106 issues a read permission signal 134 to the address control circuit 108, the read control circuit 109, and the data control circuit 112.

The reference numeral "T4" denotes a time of the first rising edge of the timing signal 152 after the address control circuit 108 receives the read permission signal 134 from the read adjustment circuit 106. At the time "T3", the address control circuit 108 outputs, to the address bus 107, the address value specifying the area of the memory where the requested piece of tone data is stored (i.e., the address of SUD1).

The reference numeral "T5" denotes a time of the first falling edge of the timing signal 153 after the read control circuit 109 receives the read permission signal 134 from the read adjustment circuit 106. At the time "T5", the read control circuit 109 issues a read signal 135 to the memory 111.

Upon receipt of the read signal 135 from the read control circuit 109, the memory 111 acquires the address value from the address bus 107 and outputs, to the data bus 110, the tone data stored at the address specified by the acquired address value (i.e., tone data SUD1).

The reference numeral "T6" denotes a time of the first falling edge of the timing signal 154 after the data control circuit 112 receives the read signal 135 from the read control circuit 109. At the time "T6", the data control circuit 112 stores the tone data (SUD1) from the data bus 110 into the buffer and outputs the buffered tone data as the output data 120.

In addition, at the time "T6", the data control circuit 112 issues a read completion signal 136 (not illustrated) to the read adjustment circuit 106.

The reference numeral "T7" denotes a time that is a predetermined time period after when the read control circuit 109 issues the read signal 135. At the time "T7", the read control circuit 109 stops issuing the read signal 135 to the memory 111.

The reference numeral "T8" denotes a time that is a predetermined time period after when the read adjustment circuit 106 issues the read permission signal 134. At the time "T8", the read adjustment circuit 106 stops issuing the read permission signal 134 to the address control circuit 108, the read control circuit 109, and the data control circuit 112. The read adjustment circuit 106 also stops issuing the bus arbitration signal 132 to the CPU 105.

The reference numeral "T9" denotes a time that is a predetermined time period after when the read adjustment circuit 106 stops issuing the bus arbitration signal 132. At the time "T9", the CPU 105 stops issuing the bus release signal 133 to the read adjustment circuit 106.

The reference numeral "T10" denotes a time of the first rising edge of the timing signal 154 after the time "T6" at which the data control circuit 112 stores the tone data into the buffer and outputs the buffered tone data. The data control circuit 112 issues a bus arbitration request signal 137 to the read adjustment circuit 106 to perform the next read operation for reading the next portion of tone data.

The reference numeral "T11" denotes a time of the first rising edge of the timing signal 151 after the read adjustment circuit 106 receives the bus arbitration request signal 137. At the time "T11", the read adjustment circuit 106 issues a bus arbitration signal 132 to the CPU 105.

The reference numeral "T12" denotes a time at which the read adjustment circuit 106 issues a read permission signal 134 to the address control circuit 108, the read control circuit 109, and the data control circuit 112. At the time "T12", in addition, the data control circuit 112 stops issuing of the bus arbitration request signal 137 to the read adjustment circuit 106.

Through the repetition of the operating steps performed from the time "T1" to "T12", entirety of the requested piece of tone data is fed to the fetch number variable circuit 113.

<Operations for Tone Signal Output and Deviation Detection>

The following describes operations performed by the tone output device 100. More specifically, the following describes operations performed by the DA converter 115 to output a tone signal from the tone data (output data 120) fed from the data control circuit 112. The following also describes operations performed for deviation detection. If it is detected that a reference portion of the multiplied clock deviates from a reference portion of the reference clock, adjustments are made to the timing of storing the tone data (output data 120) fed from the data control circuit 112 into the buffer and also to the output timing of the buffered tone data to the DA converter 115 repeatedly for the number of over sampling times. In addition, the timing of asserting the mask signal 138 and the deviation monitoring signal 139 is reset to the initial state.

<Tone Signal Output>

The fetch number variable circuit 113 receives the tone data (output data 120) from the data control circuit 112 in sync with the timing signal 155 that is generated based on the clock 141. The fetch number variable circuit 113 then stores the received tone data into the buffer.

In addition, the fetch number variable circuit 113 generates and outputs a timing signal 156 to the timing adjustment circuit 114. The fetch number variable circuit 113 also outputs the buffered tone data (output data 121) to the timing adjustment circuit 114 repeatedly for the number of oversampling times in sync with the timing signal 156.

The timing adjustment circuit 114 receives the tone data (output data 121) from the fetch number variable circuit 113 in sync with the timing signal 156 that is also received from the fetch number variable circuit 113. The timing adjustment circuit 114 then outputs the received tone data as output data 122 along with the timing signal 157 to the DA converter 115. The timing signal 157 is equal in frequency to the timing signal 156.

The DA converter 115 receives the tone data (output data 122) in sync with the timing signal 157 that is received from the timing adjustment circuit 114. The DA converter 115 then interpolates the received tone data, converts the resulting data into an analog tone signal, and outputs the tone signal in sync with a clock generated by dividing the clock 141.

<Operations of Deviation Detection and after Detection>

The timing control circuit 104 generates a mask signal 138 from the clock 142 that is fed from the multiplication circuit 103 and outputs the thus generated mask signal 138 to the timing adjustment circuit 114.

The fetch number variable circuit 113 generates a deviation monitoring signal 139 from the clock 141 that is fed from the oscillator 102 and outputs the resulting deviation monitoring signal 139 to the timing adjustment circuit 114.

The timing adjustment circuit 114 judges whether a reference portion of the deviation monitoring signal 139 that is received from the fetch number variable circuit 113 coincides with a reference portion of the mask signal 138 that is received from the timing control circuit 104.

If the reference portion of deviation monitoring signal 139 deviates from the reference portion of the mask signal 138, the timing adjustment circuit 114 detects the situation. Upon detection of the deviation, the timing adjustment circuit 114 issues a synchronous reset signal 140 to the timing control circuit 104 and the fetch number variable circuit 113.

Upon receipt of the synchronous reset signal 140, the fetch number variable circuit 113 adjusts the output timing of the timing signal 155, so that the timing signal 155 does not coincide with a changeover between different portions of tone data that are sequentially output from the data control circuit 112. In addition, the fetch number variable circuit 113 adjusts the output timing of the timing signal 156 accordingly.

In addition, the fetch number variable circuit 113 resets the assertion timing of the deviation monitoring signal 139 to the initial state.

Upon receipt of the synchronous reset signal 140, the timing control circuit 104 resets the assertion timing of the mask signal 138 to the initial state.

<Description with Reference to Timing Chart>

The above operations are now described with reference to the timing charts illustrated in FIGS. 3 and 4.

In the description below, the following are supposed. That is, the sampling frequency of tone data is 10 KHz. The number of oversampling times is seven. The resolution of the DA converter is 12 bits. The frequency of the clock 141 is 4 MHz. The multiplication circuit 103 is a quadrupler circuit. The frequency of the clock 142 is 16 MHz.

In the description below, in addition, it is supposed that the timing control circuit 104 internally generates a signal by dividing the clock 142 (hereinafter, referred to as the "timing control circuit internal signal") and the fetch number variable circuit 109 internally generates a signal by dividing the clock 141 (hereinafter, referred to as the "variable circuit internal signal").

Similarly to the timing signals 156 and 157, the timing control circuit internal signal and the variable circuit internal signal includes as many clock pulses as the number of oversampling times at each sampling interval.

<Example in which No Deviation Occurs>

Figure 3:
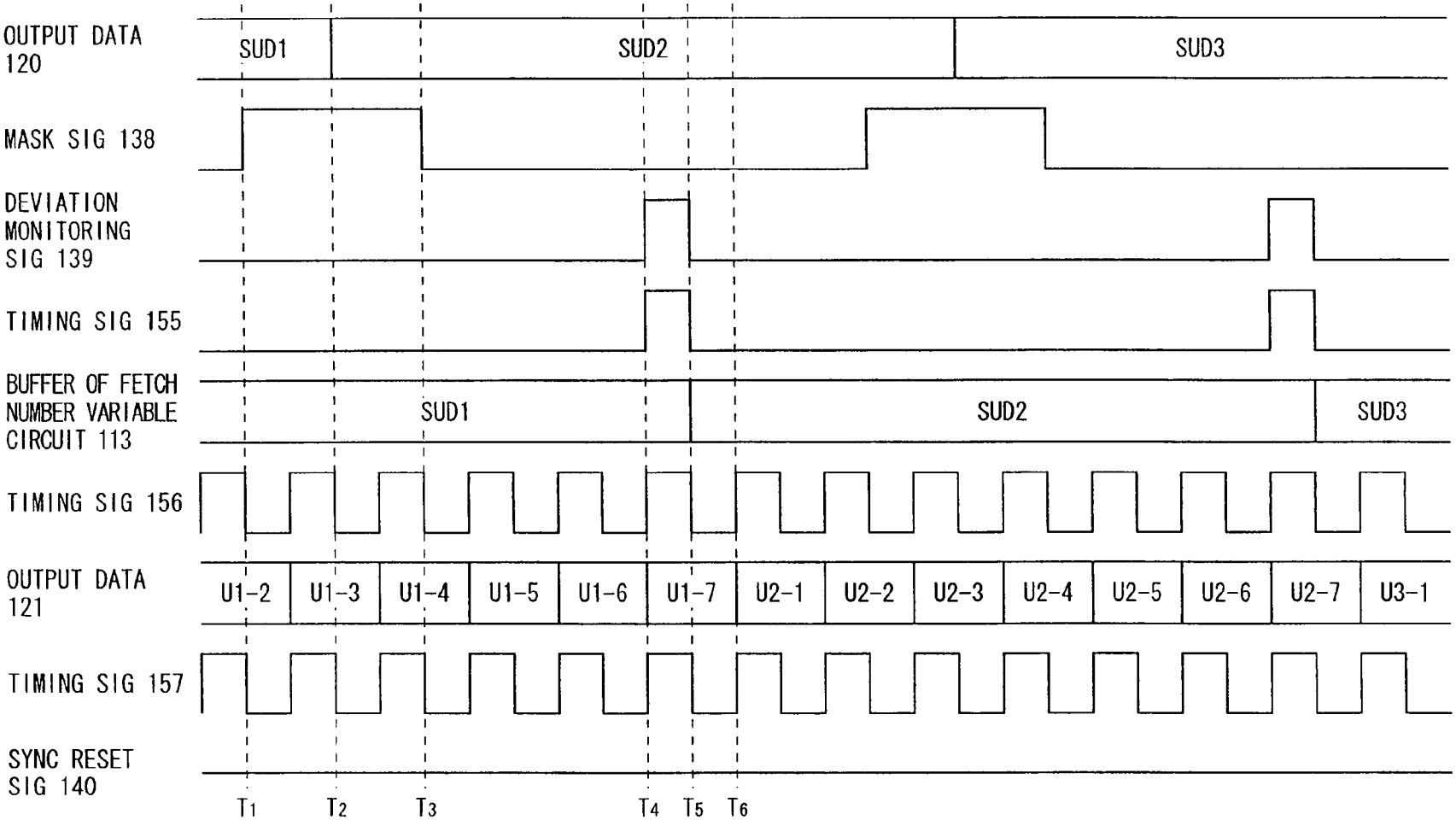
FIG. 3 is a timing chart of operations performed by a timing adjustment circuit 114 according to the embodiment 1 in the case where no deviation occurs.

FIG. 3 is a timing chart of an example in which a reference portion (HIGH portion) of the deviation monitoring signal 139 does not deviate from a reference portion (LOW portion) of the mask signal 138. In other words, a reference portion of the clock 142 does not deviate from a reference portion of the clock 141.

In this example, seven intervals of the timing control circuit internal signal (not illustrated) are regarded as one cycle. In the figure, the reference numeral "T1" denotes a time of a falling edge of the timing control circuit internal signal in the $2^{nd}$ interval. At the time "T1", the timing control circuit 104 issues a mask signal 138 to the timing adjustment circuit 114.

The reference numeral "T2" denotes a time of a falling edge of the timing signal 154 (not illustrated). At the time "T2", the data control circuit 112 outputs tone data (SUD2) as output data 120.

The reference numeral "T3" denotes a time of a falling edge of the timing control circuit internal signal in the 4th interval. Here again, seven intervals of the timing control circuit internal signal are regarded as one cycle. At the time "T3", the timing control circuit 104 stops issuing the mask signal 138 to the timing adjustment circuit 114.

As described above, the mask signal 138 is asserted for a period from "T1" to "T3". That is, the mask signal 138 rises before and falls after a changeover between two pieces of output data 120.

Since the deviation monitoring signal 139 is not asserted in the time period from "T1" to "T3" during which the mask signal 138 is asserted, the timing adjustment circuit 114 judges that the reference portion of the clock 142 does not deviated from the reference portion of the clock 141. Thus, the synchronous reset signal 140 is maintained at the LOW level.

The reference numeral "T4" denotes a time of the rising edge of the variable circuit internal signal (not illustrated) in the $7^{th}$ interval. Here again, seven intervals of the variable circuit internal signal are regarded as one cycle. At the time "T4", the fetch number variable circuit 113 issues a deviation monitoring signal 139 to the timing adjustment circuit 114 and also outputs a rising edge of the timing signal 155.

The reference numeral "T5" denotes a time of a falling edge of the variable circuit internal signal in the $7^{th}$ interval. Here again, seven intervals of the variable circuit internal signal are regarded as one cycle. At the time "T5", the fetch number variable circuit 113 stops issuing the deviation monitoring signal 139 to the timing adjustment circuit 114.

As described above, the deviation monitoring signal 139 at the initial state is asserted during the time corresponding to a reference portion of the mask signal 138.

In addition, the time "T5" also coincides with a falling edge of the timing signal 155. Thus, at the time "T5", the fetch number variable circuit 113 stores the tone data (SUD2) fed from the data control circuit 112 into the buffer.

As described above, the timing signal 155 at the initial state is asserted during the time corresponding to a reference portion of the mask signal 138.

The reference numeral "T6" denotes a time of the first rising edge of the timing signal 156 after the fetch number variable circuit 113 buffers the tone data (SUD2). At the time "T6", the fetch number variable circuit 113 repeatedly outputs the buffered tone data (SUD2) as the output data 121 (U2-1) as many times as the number of oversampling times.

Thereafter, the fetch number variable circuit 113 outputs the buffered tone data (SUD2) as the output data 121 (from "U2-2" to "U2-7") in sync with a rising edge of the timing signal 156.

<Example in which Deviation Occurs>

Figure 4:
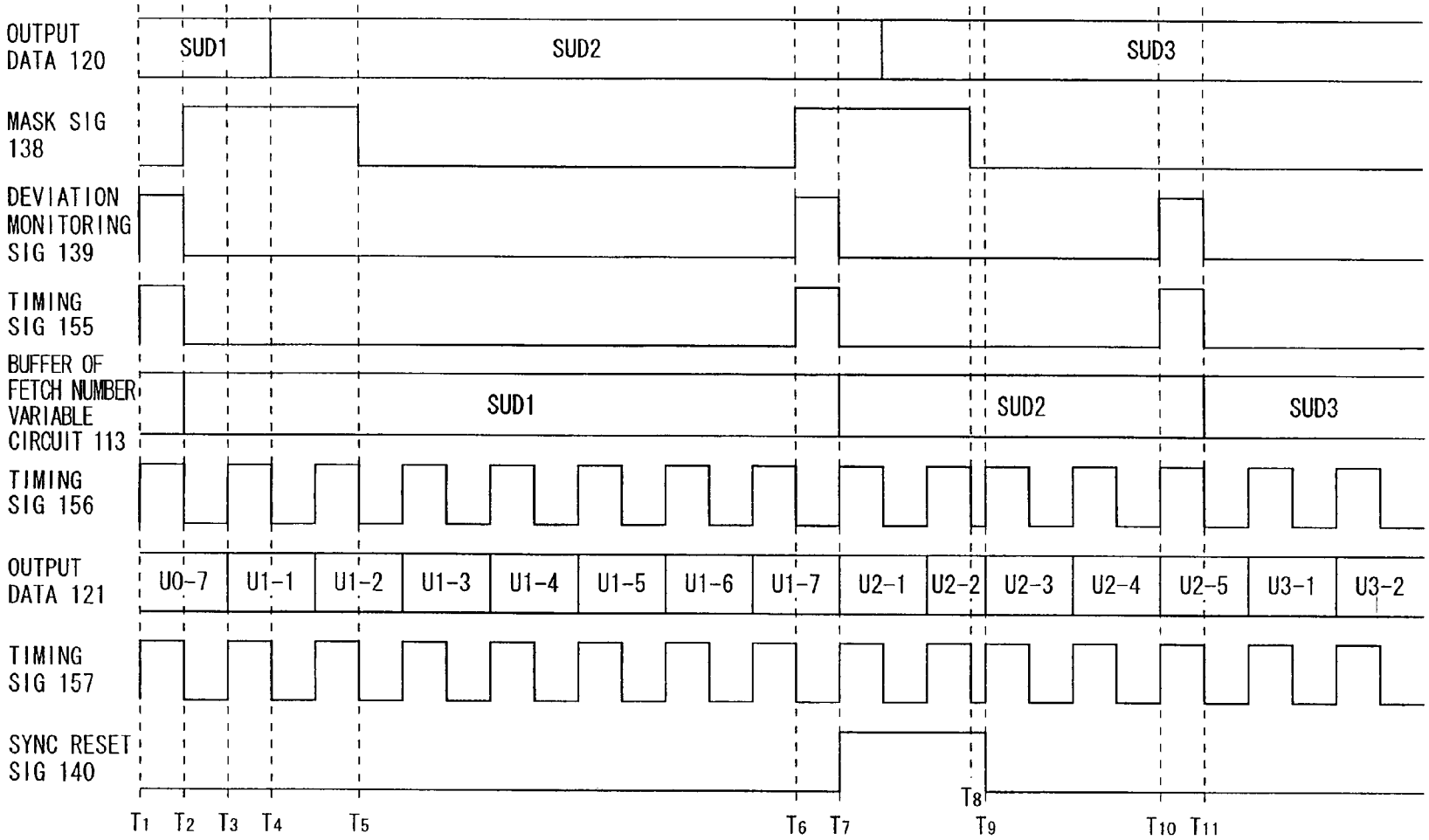
FIG. 4 is a timing chart of operations performed by the timing adjustment circuit 114 in the case where deviation occurs.

FIG. 4 is a timing chart of an example in which the deviation monitoring signal 139 deviates from the mask signal 138. In other words, a reference portion of the clock 142 deviates from a reference portion of the clock 141.

Note that since a reference portion of the clock 142 deviates from a reference portion of the clock 141, there is a deviation between a reference portion of the timing control circuit internal signal and a reference portion of the variable circuit internal signal. The variable circuit internal signal is generated based on the clock 141, whereas the timing control circuit internal signal is generated based on the clock 142.

The reference numeral "T1" denotes a time of a rising edge of the variable circuit internal signal (not illustrated) in the $7^{th}$ interval. In this example, seven intervals of the variable circuit internal signal are regarded as one cycle. At the time "T1", the fetch number variable circuit 113 issues a deviation monitoring signal 139 to the timing adjustment circuit 114 and outputs a rising edge of the timing signal 155.

The reference numeral "T2" denotes a time of a falling edge of the variable circuit internal signal in the $7^{th}$ interval. Here again, seven intervals of the variable circuit internal signal are regarded as one cycle. At the time "T2", the fetch number variable circuit 113 stops issuing the deviation monitoring signal 139 to the timing adjustment circuit 114.

In addition, the time "T2" coincides with a falling edge of the timing signal 155. At the time "T2", the fetch number variable circuit 113 stores the tone data (SUD1) fed from the data control circuit 112 into the buffer.

In addition, the time "T2" coincides with a falling edge of the timing control circuit internal signal (not illustrated) in the $2^{nd}$ interval. Here again, seven intervals of the timing control circuit internal signal are regarded as one cycle. At the time "T2", the timing control circuit 104 issues a mask signal 138 to the timing adjustment circuit 114.

The reference numeral "T3" denotes a time of the first rising edge of the timing signal 156 after the fetch number variable circuit 113 stores the tone data (SUD1) into the buffer. At the time "T3", the fetch number variable circuit 113 outputs the buffered tone data (SUD1) as output data 121 (U1-1). The data 121 (U1-1) is repeatedly output as many times as the number of oversampling times.

Thereafter, the fetch number variable circuit 113 outputs the buffered tone data (SUD1) as the output data 121 (from "U1-2" to "U1-7") in sync with a rising edge of the timing signal 156.

The reference numeral "T4" denotes a time of a falling edge of the timing signal 154 (not illustrated). At the time "T4", the data control circuit 112 outputs the tone data (SUD2) as the output data 120.

The reference numeral "T5" denotes a time of a falling edge of the timing control circuit internal signal in the $4^{th}$ interval. Here again, seven intervals of the timing control circuit internal signal are regarded as one cycle. At the time "T5", the timing control circuit 104 stops issuing the mask signal 138 to the timing adjustment circuit 114.

Since the deviation monitoring signal 139 is not asserted in the time period from "T2" to "T5" during which the mask signal 138 is asserted, the timing adjustment circuit 114 judges that a reference portion of the clock 142 does not deviate from a reference portion of the clock 141. Thus, the synchronous reset signal 140 is maintained at the LOW level.

The reference numeral "T6" denotes a time of a falling edge of the timing control circuit internal signal in the $2^{nd}$ interval. Here again, seven intervals of the timing control circuit internal signal are regarded as one cycle. At the time "T6", the timing control circuit 104 issues a mask signal 138 to the timing adjustment circuit 114.

In addition, the time "T6" coincides with a rising edge of the variable circuit internal signal in the $7^{th}$ interval. Here again, seven intervals of the timing control circuit internal signal are regarded as one cycle. At the time "T6", the fetch number variable circuit 113 issues a deviation monitoring signal 139 to the timing adjustment circuit 114.

At the time "T6", a reference portion of the deviation monitoring signal 139 overlaps a HIGH portion of the mask signal 138. Thus, the timing adjustment circuit 114 judges that the reference portion of clock 142 deviates from the reference portion of the clock 141.

At the time "T6", in addition, the fetch number variable circuit 113 outputs a rising edge of the timing signal 155.

The reference numeral "T7" denotes a time of the first rising edge of the timing signal 156 after the timing adjustment circuit 114 judges that there is a deviation between reference portions of the clocks 141 and 142. At the time "T7", the timing adjustment circuit 114 issues a synchronous reset signal 140 to the timing control circuit 104 and the fetch number variable circuit 113.

In addition, the time "T7" coincides with a falling edge of the timing signal 155. Thus, at the time "T7", the fetch number variable circuit 113 receives tone data (SUD2) from the data control circuit 112 and stores the received tone data into the buffer.

In addition, the time "T7" coincides with the first rising edge of the timing signal 156 after the fetch number variable circuit 113 buffers the tone data (SUD2). Thus, the fetch number variable circuit 113 outputs the buffered tone data (SUD2) as output data 121 (U2-1).

Thereafter, the fetch number variable circuit 113 outputs the buffered tone data (SUD2) as the output data 121 (from "U2-2" to "U2-5") in sync with the rising edge of the timing signal 156.

The reference numeral "T8" denotes a time of a falling edge of the timing control circuit internal signal in the $4^{th}$ interval. Here again, seven intervals of the timing control circuit internal signal are regarded as one cycle. At the time "T8", the timing control circuit 104 stops issuing the mask signal 138 to the timing adjustment circuit 114.

The reference numeral "T9" denotes a time of the first rising edge of the clock 141 (not illustrated) received by the timing adjustment circuit 114 after the timing control circuit 104 stops issuing of the mask signal 138. At the time "T9", the timing adjustment circuit 114 stops issuing the synchronous reset signal 140 to the timing control circuit 104 and the fetch number variable circuit 113.

Upon the termination of the synchronous reset signal 140, the timing adjustment circuit 114 adjust output timing of timing signal 156 by outputting the rising edge of next pulse. As a result, output duration of the output data 121 (U2-2) is shortened as compared with a normal output duration.

Since the timing signal 157 is in sync with the timing signal 156, the next rising edge of the timing signal 157 is output concurrently with the rising edge of timing signal 156.

The reference numeral "T10" denotes a time at which rising edges of the timing signal 155 and the deviation monitoring signal 139 are output after the reset at the time "T9". That is, the reset at the time "T9" brings the assertion timing of the timing signal 155 and the deviation monitoring signal 139 back to the initial state. Thus, the respective signals are asserted at a time corresponding to a reference portion of the mask signal 138.

As described above, the timing with which the timing signal 155 is asserted is reset to the initial state if a reference portion of the clock 142 deviates from a reference portion of the clock 141 by a predetermined amount or more. This arrangement prevents occurrence of clock racing.

Modification 1

<Overview>

According to the embodiment 1 above, reading of tone data is started after the right to use the bus is arbitrated between the read adjustment circuit 106 and the CPU 105.

Arbitration of the bus-use right starts when the read adjustment circuit 106 issuers a bus arbitration signal 132 to the CPU 105, and ends when the CPU 105 issues a bus release signal 133 to the read adjustment circuit 106.

It should be noted, however, that the CPU 105 releases each bus with the timing not causing any trouble to the control being executed at the time of starting the arbitration. A bus release signal 133 is then issued to the read adjustment circuit 106. Thus, the time period elapsed from the read adjustment circuit 106 issues a bus arbitration signal 132 until the CPU 105 subsequently issues a bus release signal 133 is not constant.

In other words, there is a risk that the data control circuit 112 fails to output the read tone data in sync with the sampling interval and thus the DA converter 115 fails to carry out DA conversion in sync with the sampling interval. In such a case, it is inevitable that the waveform of the output tone signal is distorted and thus the sound quality degrades.

In view of the above risk, a data control circuit according to a modification 1 of the present invention is composed of a first data control circuit and a second data control circuit. Each of the first and second data control circuit has an internal buffer.

The first data control circuit receives tone data from the data bus after the bus-use right arbitration with the CPU and then outputs the received tone data to the second data control circuit. The second data control circuit outputs the tone data received from the first data control circuit in sync with the sampling interval.

This ensures that tone data is output from the data control circuit to the fetch number variable circuit 113 at a constant interval, even if the time taken by the CPU from the arbitration start to issue a bus release signal is not constant. As a consequence, the DA converter is enabled to output a tone signal without waveform distortion.

<Structure>

The tone output device according to the modification 1 is identical to the tone output device 100 according to the embodiment 1, except that the data control circuit 112 is replaced with a data control circuit 201.

Since all the components other than the data control circuit 201 are identical to the components of the embodiment 1, no description of such components is given.

Figure 5:
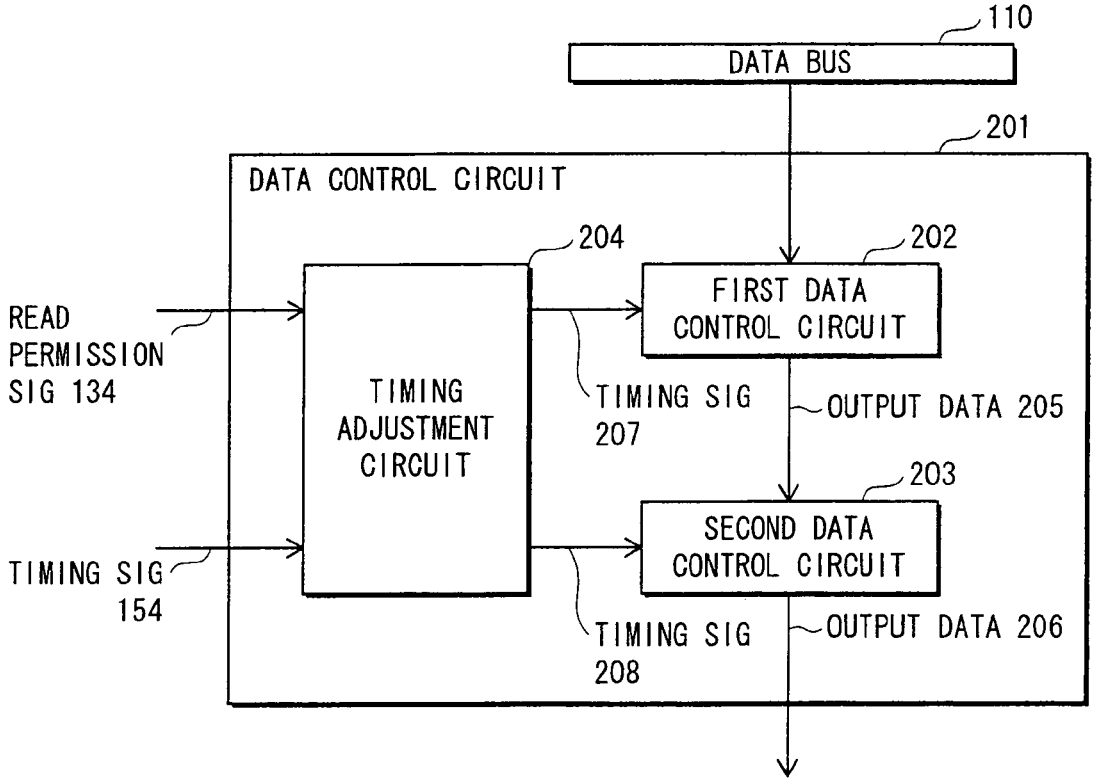
FIG. 5 is a block diagram of a data control circuit 201 according to a modification 1 of the present invention.

FIG. 5 is a block diagram of the data control circuit 201.

The data control circuit 201 is composed of a first data control circuit 202, a second data control circuit 203, and a timing adjustment circuit 204.

The first data control circuit 202 stores tone data fed from the memory 111 to the data bus 110 into its internal buffer. The storing of tone data is performed in sync with a later-described timing signal 207 that is output from the timing adjustment circuit 204. The first data control circuit 202 then outputs the buffered tone data as output data 205 to the second data control circuit 203, which will be described later.

The second data control circuit 203 stores tone data (output data 205) fed from the first data control circuit 202 into its internal buffer. The storing of tone data is performed in sync with a later-described timing signal 208 that is output from the timing adjustment circuit 204. The second data control circuit 203 then outputs the buffered tone data as output data 206 to the fetch number variable circuit 113.

The timing adjustment circuit 204 generates the timing signals 207 and 208 from the timing signal 154 of which frequency is equal to the sampling frequency. The details of the timing signals 207 and 208 are described later in detail with reference to timing charts.

<Operations>

Figure 6:
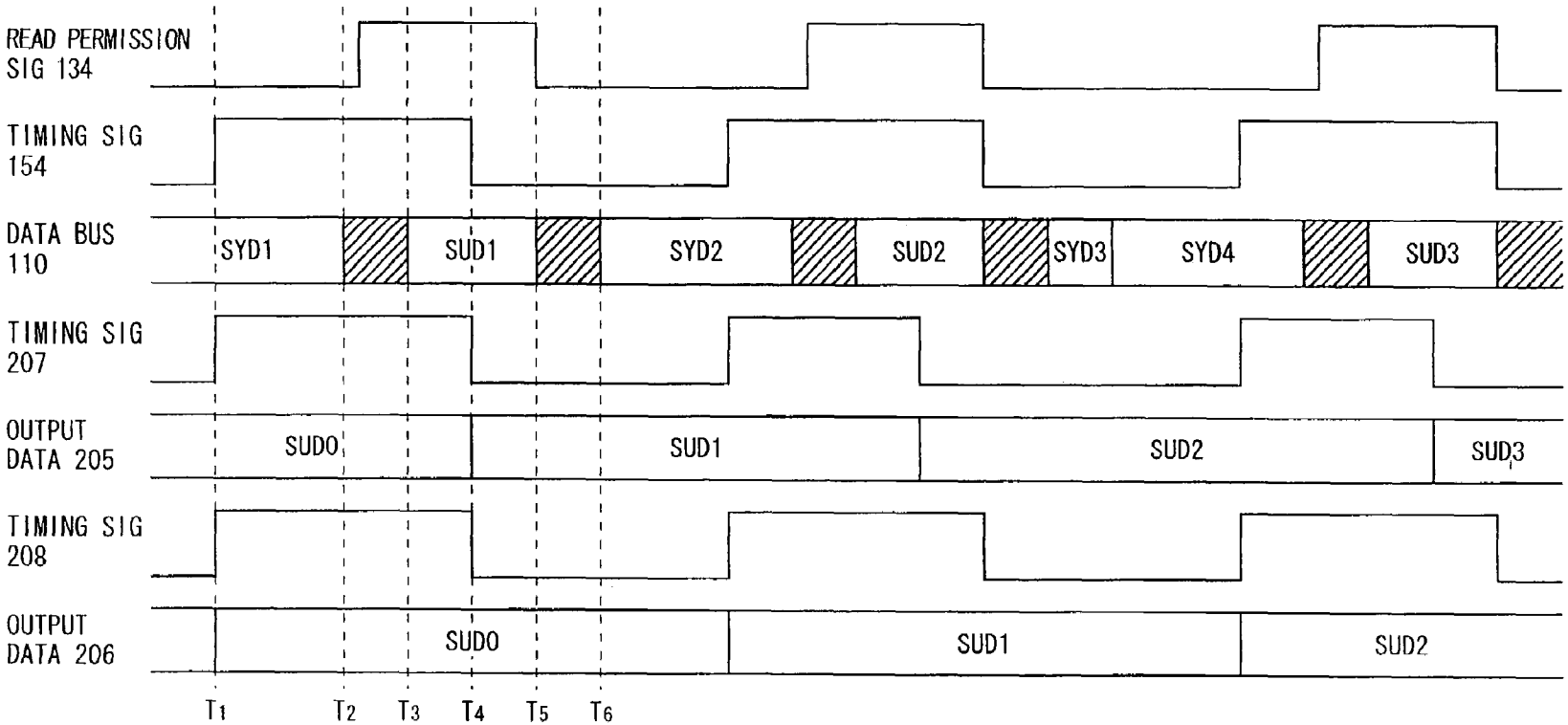
FIG. 6 is a timing chart of operations performed by the data control circuit 201.

The following describes operations of the data control circuit 201 with reference to a timing chart. FIG. 6 is the timing chart of operations of the data control circuit 201.

In the description below, the following are supposed. That is, the size of tone data that the first data control circuit 202 stores at a time and outputs as output data 205 at a time is equal to the size of tone data that the second data control circuit 203 stores at a time and outputs as output data 206 at a time.

It is also supposed that the reference numerals "SYD1", "SYD2", "SYD3", and "SYD4" denote pieces of control program etc. read by the CPU 105. In addition, the reference numerals "SUD0", "SUD1", "SUD2", and "SUD3" denote pieces of tone data. Note that size of each piece of control program etc. differs depending on the type of control executed by the CPU 105.

In the figure, the reference numeral "T1" denotes a time of a rising edge of the timing signal 154. Concurrently with the rising edge of the timing signal 154, rising edges of the timing signals 207 and 208 are output. Concurrently with the rising of the timing signal 208, the second data control circuit 203 receives tone data (SUD0) from the first data control circuit 202 and stores the received tone data into the buffer. The second data control circuit 203 then outputs the buffered tone data (SUD0) as output data 206.

The reference numeral "T2" denotes a time at which the CPU 105 issues a bus release signal 133 (not illustrated) to the read adjustment circuit 106. At the time "T2", the memory 111 stops feeding the control program etc. (SYD1) to the data bus 110. Since the size of control program etc. differs depending on the type of control, the time "T2" is offset from the time "T1" by an undefined amount of time.

The reference numeral "T3" denotes a time at which the read control circuit 109 issues a read signal 135 (not illustrated) to the memory 111. At the time "T3", the memory 111 feeds tone data (SUD1) to the data bus 110.

The reference numeral "T4" denotes a time that is a predetermined time period after when the timing adjustment circuit 204 receives the read permission signal 134. The time "T4" also coincides a falling edge of the timing signal 207. At the time "T4", the first data control circuit 202 receives the tone data (SUD1) from the data bus to store the received tone data into the buffer and sequentially outputs the buffered tone data (SUD1) as output data 205.

In addition, the time "T4", the timing signal 154 falls and the timing signal 208 falls as well.

The reference numeral "T5" denotes a time at which the read adjustment circuit 106 stops issuing the read permission signal 134 to the address control circuit 108, the read control circuit 109, and the data control circuit 201. At the time "T5", the memory 111 stops feeding the tone data (SUD1) to the data bus 110.

The reference numeral "T6" denotes a time at which the CPU 105 stops issuing the bus release signal 133 (not illustrated) to the read adjustment circuit 106. At the time "T6", the memory 111 feeds the control program etc. (SYD2) to the data bus 110.

Thereafter, the above operations performed from the time "T1" to "T6" are repeated until playback of the requested piece of tone data completes.

Note that the interval at which output of each piece of output data 205 starts is not constant (output durations of SUD1 and of SUD2 are not equal to each other). Similarly to the case of output data 120 output by the data control circuit 112 according to the embodiment 1, this is because the CPU 105 releases each bus with the timing not causing any problem to the control being executed at the time of starting bus-use right arbitration.

On the other hand, the interval at which the second data control circuit 203 starts to output each piece of output data 206 is constant (output durations of SUD0 and of SUD1 are equal to each other) and in sync with the sampling interval. Consequently, it is ensured that waveform distortion of the tone signal output is prevented.

Modification 2

<Overview>

According to the embodiment 1, arbitration of the bus-use right is required once before and once after each tone data fetching by the data control circuit 112 from the memory 111 via the data bus 110.

During the time of bus-use right arbitration, neither the CPU 105 nor the data control circuit 112 is allowed to fetch data from the data bus 110. Therefore, a time period during which the data bus 110 is not available often occurs.

In view of the above, a data control circuit according to a modification 2 of the present invention fetches tone data from the memory via the data bus successively for a plurality of times. The bus-use right is required to be granted once before and once after the successive fetching operations. This modification ensures the effective use of the data bus 110.

<Structure>

The tone output device according to the modification 2 is basically identical to the tone output device 100 according to the embodiment 1, except that the data control circuit 112 is replaced with the data control circuit 301. Since all the components other than the data control circuit 301 is identical to the corresponding components according to the embodiment, 1, a description thereof is omitted.

In the following description, it is supposed that the data control circuit 301 fetches tone data two times in succession from the memory 111 via the data bus 110.

Figure 7:
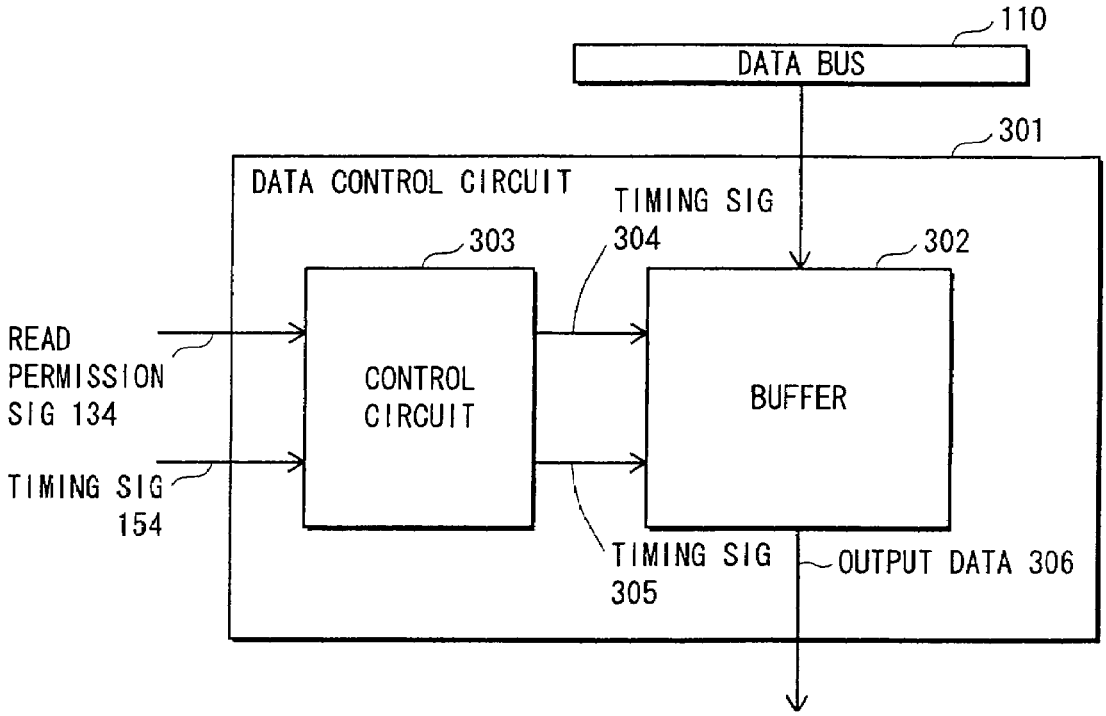
FIG. 7 is a block diagram of a data control circuit 301 according to a modification 2 of the present invention.

FIG. 7 is a block diagram of the data control circuit 301.

The data control circuit 301 is composed of a buffer 302 and a control circuit 303.

The buffer 302 is basically identical to the buffer included in the data control circuit 112 according to the embodiment 1. The buffer 302 differs from the data bus 110 in capacity, so that the buffer 302 is capable of storing a sufficient amount of tone data to be fetched successively for the predetermined number of times. Under control by the control circuit 303, the buffer 302 stores tone data in sync with timing signal 304 and outputs tone data in sync with a timing signal 305. The timing signals 304 and 305 will be described later.

The control circuit 303 controls tone data storing to the buffer 302 as well as tone data output from the buffer 302. In addition, the control circuit 303 generates timing signals 304 and 305. The timing signal 304 is generated by quadrupling the timing signal 154 of which frequency is equal to the sampling frequency. The timing signal 305 is equal in frequency to the timing signal 154.

<Operations>

Figure 8:
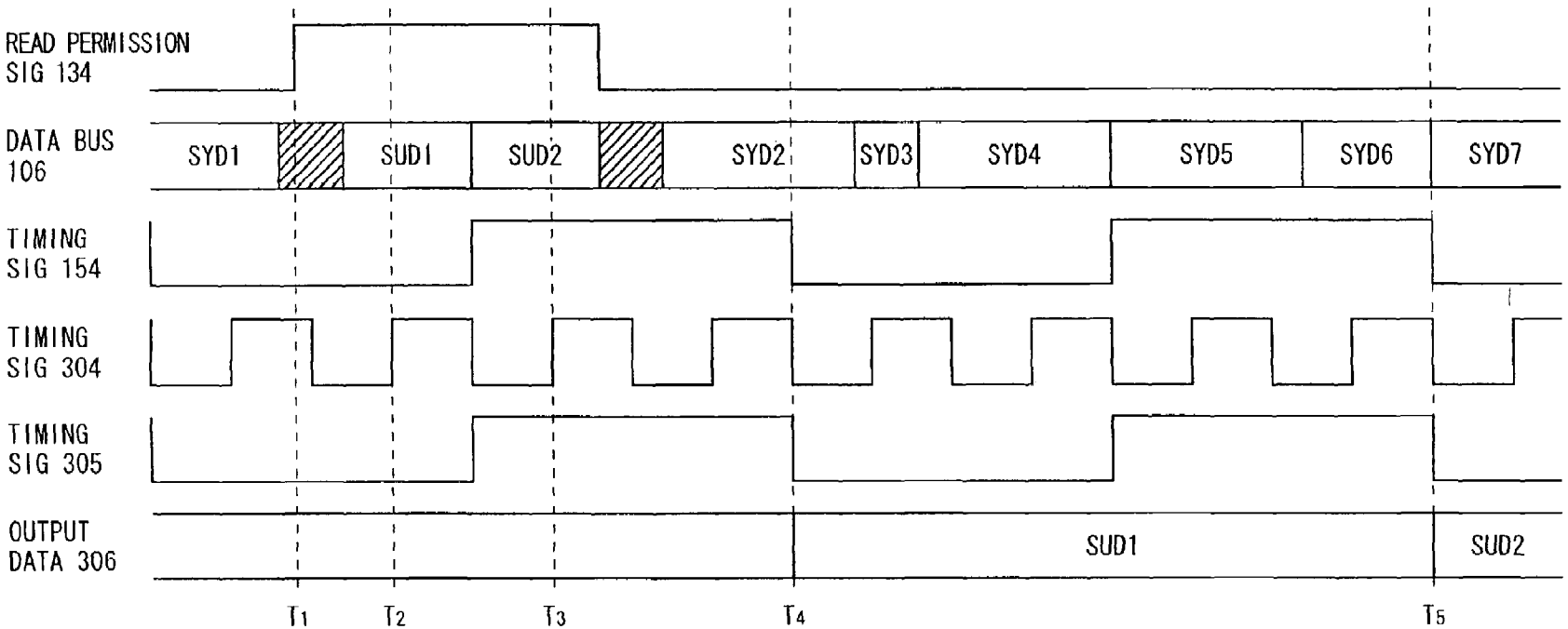
FIG. 8 is a timing chart of operations performed by the data control circuit 301.

FIG. 8 is a timing chart of operations performed by the data control circuit 301 according to the modification 2. In the following description, it is supposed that the size of tone data stored into the buffer 302 at a time is equal to the size of tone data output from the data control circuit 301 to the fetch number variable circuit 113 at a time.

In addition, the reference numerals "SYD1", "SYD2", "SYD3", "SYD4", "SYD5", "SYD6", and "SYD7" refer to pieces of control program etc. read by the CPU 105. In addition, the reference numerals "SUD1" and "SUD2" refer to pieces of tone data. Note that the pieces of control program etc. vary in size depending on the types of control executed by the CPU 105.

The reference numeral "T1" denotes a time of the first rising edge of the timing signal 151 (not illustrated) after the read adjustment circuit 106 receives a bus release signal 133 (not illustrated) from the CPU 105. At the time "T1", the read adjustment circuit 106 outputs a read permission signal 134 to the address control circuit 108, the read control circuit 109, and the data control circuit 301.

The reference numeral "T2" denotes a time of the first rising edge of the timing signal 304 after the read adjustment circuit 106 outputs the read permission signal 134. At the time "T2, the data control circuit 301 stores the tone data (SUD1) from the data bus 110 into the buffer 302 (not illustrated).

The reference numeral "T3" denotes a time of the second rising edge of the timing signal 304 after the read adjustment circuit 106 issues the read permission signal 134. At the time "T3", the data control circuit 301 stores the tone data (SUD2) from the data bus 110 into the buffer 302.

The reference numeral "T4" denotes a time of the first falling edge of the timing signal 154 after the read adjustment circuit 106 outputs the read permission signal 134. The time "T4" also coincides with a falling edge of the timing signal 305, so that the data control circuit 301 outputs, as output data 306, the tone data (SUD1) stored in the buffer 302.

The reference numeral "T5" is a time of the second falling edge of the timing signal 154 after the read adjustment circuit 106 outputs the read permission signal 134. The time "T5" coincides with a falling edge of the timing signal 305, so that the data control circuit 301 outputs, as output data 306, the tone data (SUD2) stored in the buffer 302.

Embodiment 2

<Overview>

The tone output device 100 according to the embodiment 1 outputs uncompressed tone data as a tone signal.

Generally, however, tone data is compressed before stored into semiconductor memory for the data size reduction. In addition, each piece of tone data may be compressed at a different compression rate.

A tone output device according to an embodiment 2 of the present invention is capable of outputting a piece of tone data compressed at any of various compression rates and outputs a tone signal.

In addition, there may be a case where the size of tone date that the data control circuit stored into the buffer at a time is not equal to an integral multiple of the size of tone data that the control circuit outputs from the buffer at a time. In such a case, after sequentially outputting of the buffered tone data, a portion of tone data that is smaller than the predetermined output size remains in the buffer (hereinafter, referred to as "remaining data").

The tone output device according to the embodiment 2 appropriately handles the remaining data to properly output a tone signal.

<Structure>

Figure 9:
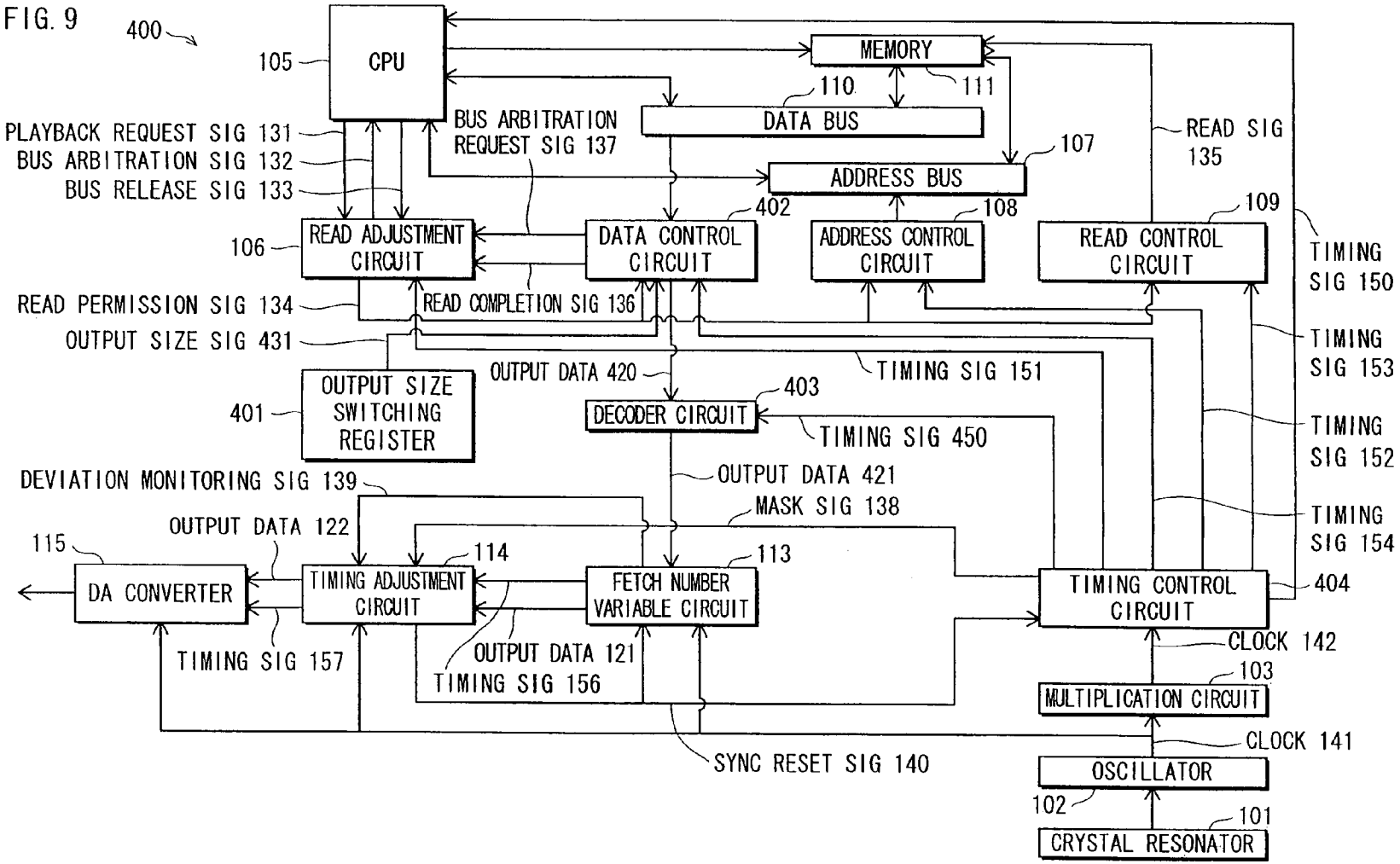
FIG. 9 is a block diagram of a tone output device 400 according to an embodiment 2 of the present invention.

FIG. 9 is a block diagram of a tone output device 400 according to the embodiment 2.

As illustrated in FIG. 9, the tone output device 400 is composed of a crystal resonator 101, an oscillator 102, a multiplication circuit 103, a CPU 105, a read adjustment circuit 106, an address bus 107, an address control circuit 108, a read control circuit 109, a data bus 110, a memory 111, a fetch number variable circuit 113, a timing adjustment circuit 114, a DA converter 115, an output-size switching register 401, a data control circuit 402, a decoder circuit 403, and a timing control circuit 404.

Note that all the components other than the output-size switching register 401, the data control circuit 402, the decoder circuit 403, the timing control circuit 404 are identical to the corresponding components according to the embodiment 1. Thus, a description of such identical components are omitted.

In the embodiment 2, one piece of tone data is compressed at a specific compression rate.

A piece of tone data is composed of a plurality of pieces of sampling data. The output-size switching register 401 stores the sampling data size having been compressed.

The data size of compressed sampling data (hereinafter, "output size") is set in advance by the CPU 105. The output-size switching register 401 outputs an output-size signal 431 indicative of the output size to the data control circuit 402, which will be described later.

The data control circuit 402 is basically identical to the data control circuit 112 described in the embodiment 1. The difference with the data control circuit 112 lies in that the data control circuit 402 sequentially outputs the buffered data portion by portion as a plurality of pieces of output data 420, to the decoder circuit 403, which will be described later. Each piece of output data 420 is of the output size indicated by an output-size signal 431 received from the output-size switching register 401.

There may be a case where the size of tone data stored by the data control circuit 402 into the buffer at a time is not equal to an integral multiple of the output size indicated by an output-size signal 431 received from the output-size switching register 401. In this case, a portion of the buffered tone data remains in the buffer.

The data control circuit 402 also differs from the data control circuit 112 in that the remaining data is saved to a buffer area that is different from a buffer area where tone data that is output from the data bus 110 is stored.

The buffer area for saving the remaining data is a separate buffer area from the buffer area for storing tone data fed to the data bus 110. Yet, the two buffer areas are physically contained within the same buffer.

Hereinafter, the buffer area for storing tone data fed to the data bus 110 is referred to as the "first buffer area" and the buffer area for saving remaining data is referred to as the "second buffer area".

In the case where the second buffer area stores remaining data is saved thereto, at the time when tone data is newly stored into the first buffer, the data control circuit 402 prepares a piece of output data 420 to be output next by adding a portion of the newly stored tone data to the remaining data, so that the piece of output data 420 amounts to the output size indicated by the output-size signal 431. Then, the data control circuit 402 outputs the resulting output data 420 to the decoder circuit 403.

Similarly to any general decoder circuit, the decoder circuit 403 sequentially decodes compressed tone data received portion by portion from the data control circuit 402 and outputs the resulting data to the fetch number variable circuit 113. The decoding is performed in sync with the timing signal 450 received from the timing control circuit 404.

The timing control circuit 404 is basically identical to the timing control circuit 104 according to the embodiment 1. The difference with the timing control circuit 104 lies in that the timing control circuit 404 generates a timing signal 450 based on the clock 142 that is received from the multiplication circuit 103 and outputs the timing signal 450 to the decoder circuit 403.

The timing signal 450 determines the operation timing of the decoder circuit 403 and the frequency of the timing signal 450 is equal to the sampling frequency.

<Operations>

The following describes operations performed by the tone output device 400 having the above described structure for the data control circuit 402 to output buffered tone data.

Note that the same operations as those described in the embodiment 1 are performed for the data control circuit 402 to store tone data fed to the data bus 110 into the first buffer area. Thus, a description thereof is omitted.

In the following description, it is supposed that the size of tone data that the data control circuit 402 stores at time is 16 bit. It is also supposed that the output size indicated by an output-size signal 431 that is output from the output-size switching register 401 is 3 bits.

<Output of Tone Data Stored Through $1^{st}$ Storing Process>

First of all, the following describes operations performed by the data control circuit 402 to output a first portion tone data that is stored through the $1^{st}$ storing process into the first buffer area to the decoder circuit 403.

Note that the CPU 105 sets in advance the compressed sampling data size (3 bits) into the output-size switching register 401. At the time when the setting is made, the output-size switching register 401 outputs an output-size signal 431 indicative of the output size (3 bits) to the data control circuit 402.

After storing the first portion of tone data into the first buffer area, the data control circuit 402 sequentially outputs, to the decoder circuit 403, the buffered tone data portion by portion as a plurality of pieces of output data 420 each having the size indicated by the output-size signal 431 that has been received from the output-size switching register 401. Each piece of output data 420 is output in sync with the timing signal 154 that is received from the timing control circuit 404.

After the data control circuit 402 outputs the $5^{th}$ piece of output data 420, 1-bit data remains in the first buffer area. Thus, the data control circuit 402 saves the 1-bit remaining data into the second buffer area.

<Output of Tone Data Stored Through $2^{nd}$ Storing Process>

Next, the following describes operations performed by the data control circuit 402 for outputting a second portion of tone data that is stored through the $2^{nd}$ storing process into the first buffer area to the decoder circuit 403.

After storing the second portion of tone data into the first buffer area, the data control circuit 402 prepares the $6^{th}$ piece of output data 420 to be output next by adding the 1-bit remaining data saved into the second buffer area to the first two bits of the tone data newly stored into the first buffer area. The size of the thus prepared piece of output data 420 is equal to the output size (3 bits) indicated by the output-size signal 431 that is received from the output-size switching register 401. The $6^{th}$ piece of output data 420 is then output to the decoder circuit 403 in sync with the timing signal 154 received from the timing control circuit 404.

The data control circuit 402 then sequentially outputs the rest of tone data stored in the first buffer area as a plurality of pieces of output data 420 to the decoder circuit 403. Each piece of output data 420 is equal in size to the output size (3 bits) indicated by the output-size signal 431 received from the output-size switching register 401. In addition, each piece of output data 420 is output in sync with the timing signal 154 that is received from the timing control circuit 404.

After the data control circuit 402 outputs the $10^{th}$ piece of output data 420, 2-bit data remains in the first buffer area. Thus, the 2-bit remaining data is saved into the second buffer area.

<Output of Tone Data Stored Through $3^{rd}$ Storing Process>

Next, the following describes operations performed by the data control circuit 402 for outputting a third portion of tone data that is stored through the $3^{rd}$ storing process into the first buffer area to the decoder circuit 403.

After storing the third portion of tone data into the first buffer area, the data control circuit 402 prepares the $11^{th}$ piece of output data 420 to be output next. The $11^{th}$ piece of output data 420 is prepared by adding, to the 2-bit remaining data saved into the second buffer area, the first one bit of the tone data that is newly stored into the first buffer area. The thus prepared piece of output data 420 is equal in size to the output size (3 bits) indicated by the output-size signal 431 that is received from the output-size switching register 401. The $11^{th}$ piece of output data 420 is then output to the decoder circuit 403 in sync with the timing signal 154 received from the timing control circuit 404.

The data control circuit 402 then sequentially outputs, to the decoder circuit 403, the rest of tone data stored in the first buffer area as a plurality of pieces of output data 420 each of which is equal in size to the output size (3 bits) indicated by the output-size signal 431 received from the output-size switching register 401. Each piece of output data 420 is output in sync with the timing signal 154 received from the timing control circuit 404. As a result, the tone data stored into the first buffer area is all output to the decoder circuit 403, without leaving any remaining data.

Thereafter, the above operations to output tone data stored through the $1^{st}$ to $3^{rd}$ storing processes are repeated. With this arrangement, the tone output device is enabled to output a proper tone signal, even if the size of tone data concurrently stored by the data control circuit 402 is not equal to an integral multiple of the size of tone data concurrently output by the data control circuit 402.

Modification 3

<Overview>

The tone output device 400 according to the embodiment 2 sequentially feeds compressed tone data stored in the buffer in the data control circuit 402 portion by portion at a constant size that is indicated by the output-size signal 431 received from the output-size switching register 401.

For the sake of data size reduction, it is desirable to compress tone data to be stored into the memory at a higher compression rate. It should be noted, however, waveform regeneration is more difficult if tone date is compressed at a higher compression rate, which leads to sound quality degradation.

One solution to the above is to compress one piece of tone data portion by portion at different compression rates. Even if the sound quality is degraded, some portions cause little influence on the overall sound quality, whereas some portions cause more notable influence. With a tone output device capable of outputting such tone data compressed portion by portion at different compression rates, the data size reduction is achieved without substantially sacrificing the overall sound quality.

According to a modification 3 of the present invention, a tone output device is capable of duly converting a piece of voice data composed of a plurality of pieces of phrase data that are compressed at different compression rates, and outputting the resulting tone data. The pieces of phrase data are compressed at different compression rates because some pieces of phrase data need to be output as a voice signal of relatively high sound quality, whereas some pieces of phrase data may be output as a voice signal of relatively low sound quality.

<Structure>

Figure 10:
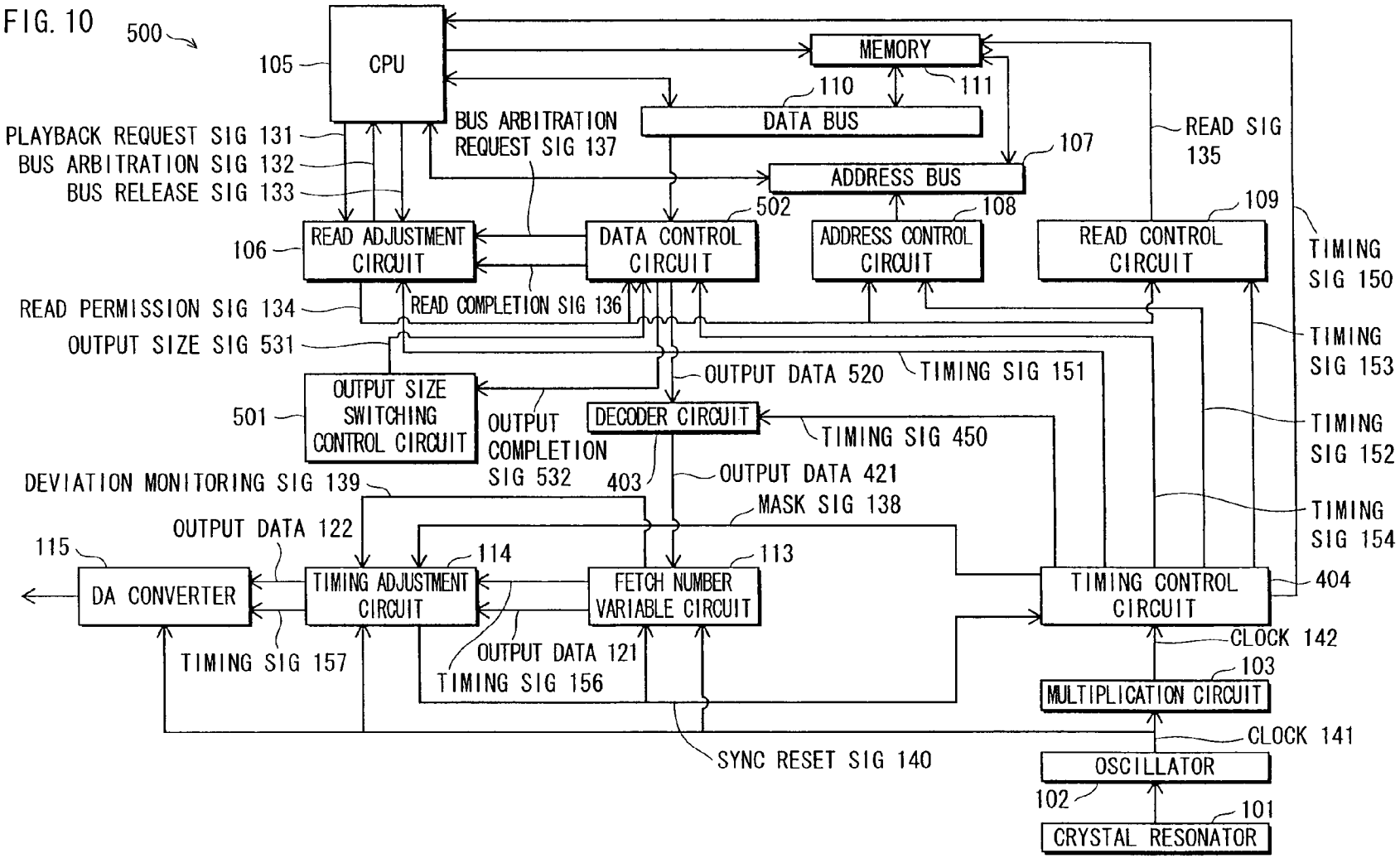
FIG. 10 is a block diagram of a tone output device 500 according to a modification 3 of the present invention.

FIG. 10 is a block diagram of a tone output device 500 according to the modification 3.

The tone output device 500 is basically identical to the tone output device according to the embodiment 2, by replacing the output-size switching register 401 and the data control circuit 402 with an output-size switching control circuit 501 and a data control circuit 502, respectively.

No description is given of the components other than the output-size switching control circuit 501 and the data control circuit 502, since they are identical to the corresponding components described in the embodiment 2.

In the modification 3, a piece of voice data is composed of a plurality of pieces of phrase data each of which is compressed at one of predetermined compression rates.

Each piece of phrase data is composed of a plurality of sampling data. The output-size switching control circuit 501 stores the sizes of compressed sampling data (hereinafter, "output size") of the respective pieces of phrase data. Prior to outputting each piece of phrase data, the output-size switching control circuit 501 issues to the data control circuit 502 an output-size signal 531 indicative of the output size of a corresponding piece of phrase data. Note that the output sizes of the respective pieces of phase data are set in advance by the CPU 105 into the internal register.

When the CPU 105 sets the output sizes of the respective pieces of phrase data, the output-size switching control circuit 501 issues an output-size signal 531 indicative of the output size of the first piece of phrase data to the data control circuit 502. Upon receipt of a later-described send completion signal 532 from the data control circuit 502, the output-size switching control circuit 501 issues another output-size signal 531 indicative of the output size of the next piece of phrase data to the data control circuit 502.

The data control circuit 502 is basically identical to the data control circuit 402 according to the embodiment 2 but differs in the flowing respect. When the CPU sets in advance the output sizes of the respective pieces of phrase data into the internal register, the data control circuit 502 sequentially outputs the buffered tone data portion by portion as a plurality of pieces of output data 520 to the decoder circuit 403. Each time one piece of phrase data is output, the data control circuit 502 issues a send completion signal 532 to the output-size switching control circuit 501.

<Operations>

The following describes operations performed by the tone output device 500 having the above-described structure for outputting tone data stored in the buffer of the data control circuit 502.

Note that the operations performed by the data control circuit 502 to store tone data fed to the data bus 110 into the buffer are identical to those described in the embodiment 1. Thus, no description thereof is repeated.

In the following description, it is supposed that the data control circuit 502 stores 12-bit voice data at a time. In addition, a piece of voice data is composed of the $1^{st}$ to $4^{th}$ pieces of phrase data.

Suppose, in addition, that the $1^{st}$ to $4^{th}$ pieces of phrase data represent the phrases "Today", "is a", "fine" "day", respectively. Sequential playback of the $1^{st}$ to $4^{th}$ pieces of phrase data produces voice output of a message "Today is a fine day".

Each of the $1^{st}$ and $3^{rd}$ pieces of phrase data is 24-bit data, and composed of a plurality of pieces 4-bit compressed sampling data.

On the other hand, the $2^{nd}$ and $4^{th}$ pieces of phrase data is 12-bit data and composed of a plurality of pieces of 3-bit compressed sampling data.

<Output of $1^{st}$ Piece of Phrase Data>

First, the following describes operations for outputting the $1^{st}$ piece of phrase data to the decoder circuit 403.

Note that the CPU 105 sets in advance the sizes of each piece of compressed sampling data constituting the respective pieces of phrase data. When the setting is made, the output-size switching control circuit 501 issues an output-size signal 531 indicative of the output size of the $1^{st}$ piece of phrase data (4 bits) to the data control circuit 502.

In addition, the CPU 105 sets in advance the data sizes of the respective pieces of phrase data into the data control circuit 502.

The data control circuit 502 stores a first portion of the $1^{st}$ piece of phrase data into the buffer. The data control circuit 502 then sequentially outputs, to the decoder circuit 403, the buffered phrase data portion by portion as a plurality of pieces of output data 520. Each piece of output data is equal in size to the output size (4 bit) indicated by the output-size signal 531 that is received from the output-size switching control circuit 501. In addition, each piece of output data 520 is output in sync with a timing signal 450 received from the timing control circuit 404.

In a similar manner, the data control circuit 502 stores the $2^{nd}$ portion of the $1^{st}$ piece of phrase data into the buffer. The data control circuit 502 then sequentially outputs, to the decoder circuit 403, the buffered phrase data portion by portion each having the output-size (4 bits) indicated by the output-size signal 531. As a result, the data control circuit 502 completes output of the $1^{st}$ piece of phrase data (24 bits) set by the CPU 105. Thus, the data control circuit 502 issues an output completion signal 532 to the output-size switching control circuit 501.

<Output of $2^{nd}$ Piece of Phrase Data>

Upon receipt of the output completion signal 532 from the data control circuit 502, the output-size switching control circuit 501 outputs, to the data control circuit 502, another output-size signal 531 indicative of the output-size (3 bits) of the $2^{nd}$ piece of phrase data.

After storing the $2^{nd}$ piece of phrase data into the buffer, the data control circuit 502 outputs to the decoder circuit 403 the buffered phrase data portion by portion as a plurality of pieces of output data 520. Each piece of output data 520 is equal in size to the output-size (3 bits) that is indicated by the output-size signal 531 received from the output-size switching control circuit 501. In addition, each piece of output data 520 is output in sync with the timing signal 450 received from the timing control circuit 404.

By outputting the buffered data, outputs of the entire $2^{nd}$ piece of phrase data (12-bit data) completes. Thus, the data control circuit 502 outputs an output completion signal 532 to the output-size switching control circuit 501.

<Output of $3^{rd}$ and $4^{th}$ Pieces of Phrase Data>

The output-size switching control circuit 501 and the data control circuit 502 outputs the $3^{rd}$ and $4^{th}$ pieces of phrase data in a similar manner to the $1^{st}$ and $2^{nd}$ pieces of phrase data.

As described above, with the tone output device 500 according to the modification 3, the pieces of phrase data representing the keywords in the entire phrase "today" and "fine" are compressed at a lower compression rate, whereas the other pieces of phrase data are compressed at a higher compression rate. With this arrangement, the size of the entire voice data is reduced to achieve the effective use of the memory, without degrading sound quality to an extent noticeable to human ear.

Embodiment 3

<Overview>

According to the embodiment 1, the data bus 110 has the m-bit width (m is an integer) that is suitably determined for operations of the CPU 105. Correspondingly to the bus width, the memory 111 outputs m-bit data at a time to the data bus 110, in response to a read signal 135 issued by the read control circuit 109.

Consequently, in the case where tone data stored in the memory 111 is not equal in size to an integral multiple of m bits, the last portion of buffered tone data is read together with unnecessary data.

If such data is converted into a tone signal, it is inevitable that the resulting tone signal includes error resulting from the unnecessary data. As a consequence, the sound quality degrades.

The above problem may be addressed by storing tone data in the memory 111 together with silent data added at the end of the tone data to make the size of tone data equal to an integral multiple of the m-bit bus width. Yet, this goes against the effective use of the memory 111.

In view of the above, a tone output device according to an embodiment 3 of the present invention controls the data control circuit so as to stop data output when the amount of buffered data having been sequentially output to the fetch number variable circuit 113 reaches the size of the tone data. This holds even if some data remains in the buffer. With this arrangement the tone output device is enabled to output a tone signal that is converted only from necessary tone data.

<Structure>

Figure 11:
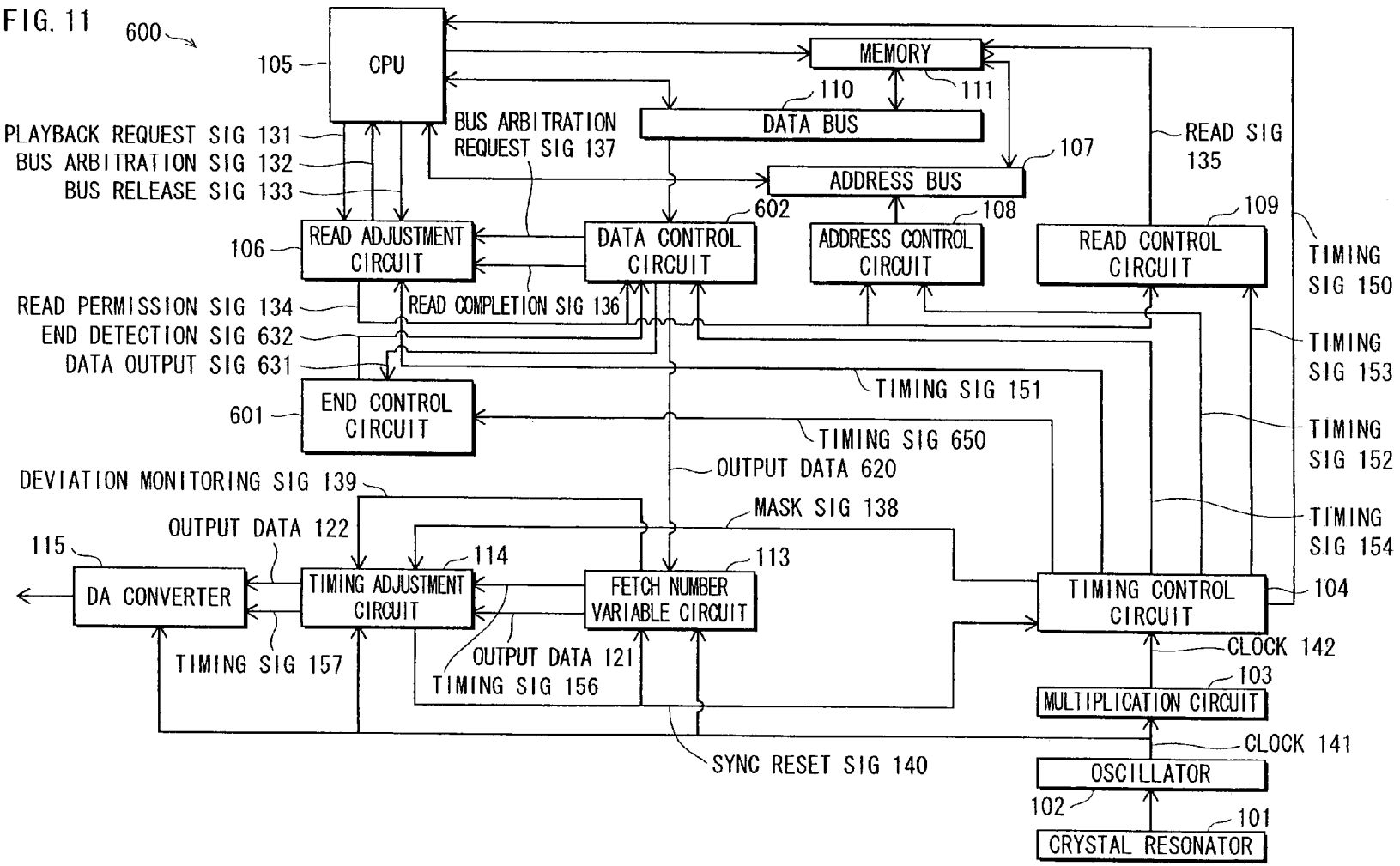
FIG. 11 is a block diagram of a tone output device 600 according to an embodiment 3 of the present invention.

FIG. 11 is a block diagram of a tone output device 600 according to an embodiment 3 of the present invention.

As illustrated in the figure, the tone output device 600 is composed of a crystal resonator 101, an oscillator 102, a multiplication circuit 103, a timing control circuit 104, a CPU 105, a read adjustment circuit 106, an address bus 107, an address control circuit 108, a read control circuit 109, a data bus 110, a memory 111, a fetch number variable circuit 113, a timing adjustment circuit 114, a DA converter 115, an end control circuit 601, and a data control circuit 602.

Note that all the components other than the end control circuit 601 and the data control circuit 602 are identical to the corresponding components of the embodiment 1. Thus, a description of such components is omitted.

The end control circuit 601 controls the data control circuit 602, so that the data control circuit 602 stops output when the size of buffered data having been output reaches the size of the tone data stored into the buffer.

To be more specific, the end control circuit 601 has an internal register that is set in advance by the CPU 105 to the size of a requested piece of tone data. In addition, the end control circuit 601 includes a counter that is incremented by "1" upon receipt of a later-described data output signal 631 from the data control circuit 602. When the counter value exceeds the value indicating the tone data size set by the CPU 105, the end control circuit 601 issues an end-detection signal 632 to the data control circuit 602. The end-detection signal 632 causing the data control circuit 602 to stop data output.

In one example, the counter included in the end control circuit 601 is a programmable counter composed of two registers: a first register and a second register.

The first register is set to the quotient of dividing the size of tone data set by the one address size. The tone data size and the one address size are both set by the CPU 105. The second register increments its counter value each time a data output signal 631 is received from the data control circuit 602. The second register overflows when its value reaches the value of the first register.

Note that the programmable counter is well known in the art and thus no detailed description is given here.

The data control circuit 602 is basically identical to the data control circuit 112 according to the embodiment 1. The difference lies in that the data control circuit 602 stops data output upon receipt of an end-detection signal 632 from the end control circuit 601, regardless of whether or not data still remains in the buffer. Another difference with the data control circuit 112 lies in that the data control circuit 602 issues a data output signal 631 to the end control circuit 601 each time tone data of one address size is output. The data output signal 631 indicates completion of output of one address size data.

<Operations>

The following describes operations performed by the tone output device 600 having the above structure for the data control circuit 602 to output tone data stored in the internal buffer.

Note that the operations by the data control circuit 602 to store tone data fed to the data bus 110 into the buffer are identical to those described in the embodiment 1. Thus, no description thereof is repeated.

In the description below, the following are supposed. That is, the width of the data bus 110 is 24 bits. The one address size of the memory 111 is 1 byte. The size of a requested piece of tone data is 40 bits. The data control circuit 602 sequentially outputs one byte of the buffered tone data.

In addition, the 40-bit tone data is stored in the memory 111 at the addresses from "01" to "05" in one-byte units. The control program is stored in the memory 111 at the address "06".

In addition, the CPU 105 sets the size of tone data as 40 bits into the end control circuit 601. In addition, the counter is initially set to the value "0" and overflows when reaching the value "5", which is a result of dividing the tone data size (40 bits) by the one address size of the memory 111 (1 byte=8 bits).

<Output of Tone Data Stored through $1^{st}$ Storing Process>

First of all, the following describes operations performed by the data control circuit 602 to output, to the fetch number variable circuit 113, a portion of tone data that is stored through the $1^{st}$ storing process.

The counter of the end control circuit 601 is initially set to the value "0" and the buffer of the data control circuit 602 stores a portion of the tone data stored in the memory 111 at the addresses from "01" to "03".

The data control circuit 602 sequentially outputs, to the fetch number variable circuit 113, the buffered tone data one byte by one byte as a plurality of pieces of output data 620. Each piece of output data 620 is output in sync with the timing signal 154 received from the timing control circuit 603. In addition, each time a piece of one-byte data is output, the data control circuit 602 issues a data output signal 631 to the end control circuit 601.

The end control circuit 601 increments the counter by "1" each time a data output signal 631 is received from the data control circuit 602.

When the data control circuit 602 outputs the $3^{rd}$ portion of the buffered tone data to the fetch number variable circuit 113, the buffer is emptied. At this stage, the counter of the end control circuit 601 holds the value "3", which is smaller than "5". Thus, the counter does not overflow yet.

<Output of Tone Data Stored Through $2^{nd}$ Storing Process>

Next, the following describes operations performed by the data control circuit 602 to output, to the fetch number variable circuit 113, another portion of the tone data that is stored thorough the $2^{nd}$ storing process.

At this stage, the counter of the end control circuit 601 holds the value "3". In addition, the data control circuit 602 has buffered a portion of the tone data that was located on the memory 111 at the addresses from "04" to "05" as well as a control program that was located on the memory 111 at the address "06".

The data control circuit 602 outputs up to the first two bytes of the buffered data (tone data stored at the addresses from "04" to "05"). In a similar manner to the output of the tone data stored thorough the $1^{st}$ storing process, the output is made in sync with the timing signal 154 received from the timing control circuit 603.

As a result, the counter of the end control circuit 601 holds the value "5", which is not smaller than the set value of "5" and thus overflows. In response to the overflow, the end control circuit 601 issues an end-detection signal 632 to the data control circuit 602.

Upon receipt of the end-detection signal 632, the data control circuit 602 stops the tone data output to the fetch number variable circuit 113. As a result, the rest of the buffered data other than the tone data (the control program located at the address "06") remains in the buffer without being output. This ensures that the DA converter 115 converts a tone signal only from tone data without any unnecessary data, and outputs the resulting tone signal.

Modification 4

<Overview>

A tone output device 700 according to a modification 4 of the present invention is a modification of the tone output device 600 according to the embodiment 3. More specifically, the end control circuit 601 is replaced by an end control circuit 701 that is simplified in structure by eliminating the counter. The end control circuit 701 is applicable to the case where the size of tone data that the data control circuit 602 stores at a time is equal to a twice one address size of the memory 111.

With this simplified structure as compared with the end control circuit 602, the end control circuit 701 achieves further cost reduction.

<Structure>

Figure 12:
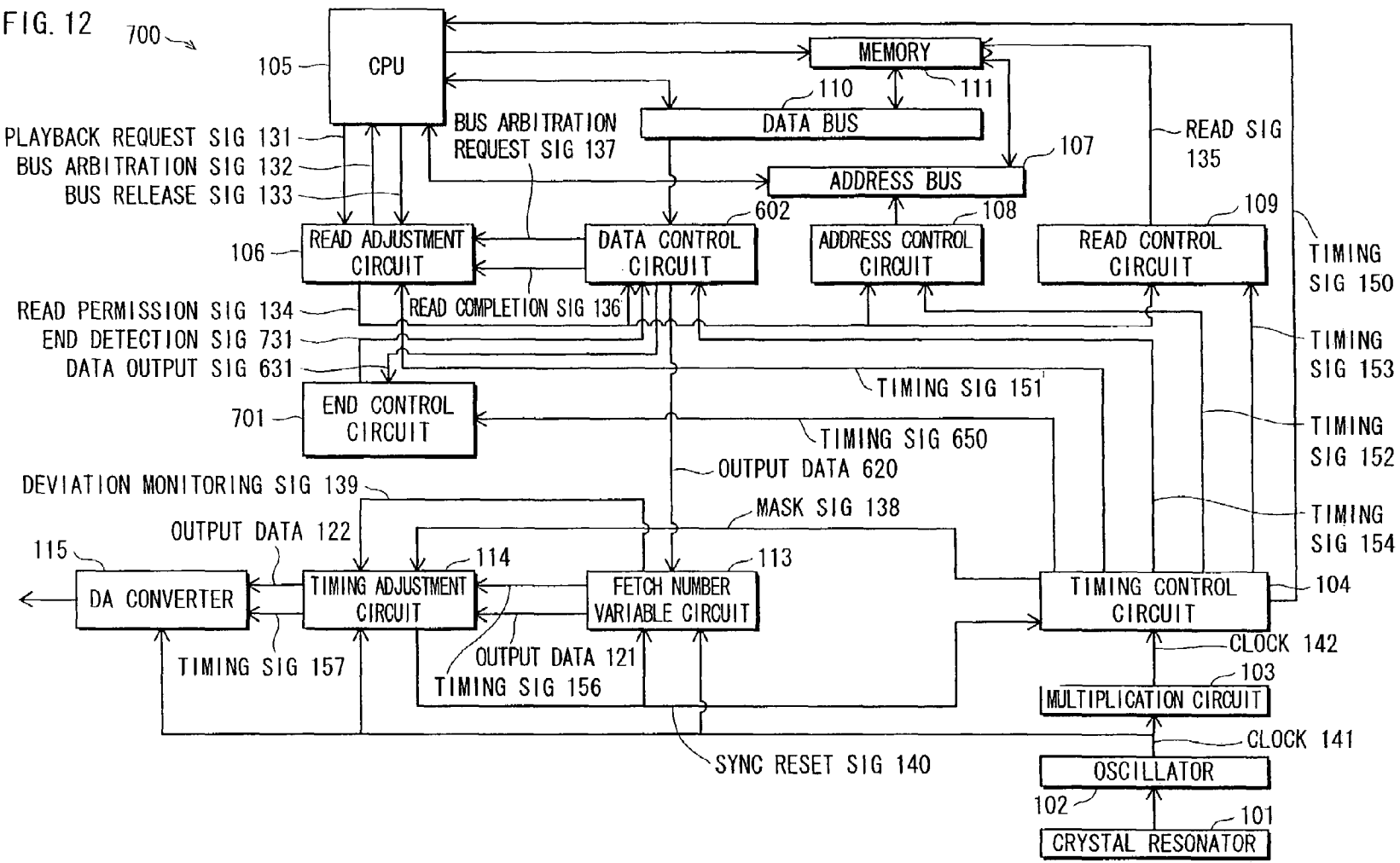
FIG. 12 is a block diagram of a tone output device 700 according to a modification 4 of the present invention.

FIG. 12 is a block diagram of the tone output device 700 according to a modification 4.

The tone output device 700 is basically identical to the tone output device 600 according to the embodiment 3, except that the end control circuit 601 is replaced by the end control circuit 701.

All the components other than the end control circuit 701 are identical to the corresponding components of the embodiment 3. Thus, a description thereof is omitted.

The CPU 105 sets in advance into the end control circuit 701, the size of a desired piece of tone data and the size of tone data that the data control circuit 602 stores at a time. With reference to the set sizes, the end control circuit 701 judges whether the desired piece of tone data occupies on the memory 111 an even number of addressees or an odd number addresses. The end control circuit 701 issues an end-detection signal 731 indicative of the detection result to the data control circuit 602.

The judgment is made based on the remainder calculated by dividing the size of the desired piece of tone data by the size of tone data that the data control circuit 602 stores at a time. Both the sizes are set in advance by the CPU 105. If the reminder is "0", it is judged that the desired piece of tone data occupies an even number addresses on the memory 111. If the remainder is not "0", on the other hand, it is judged that the desired piece of tone data occupies an odd number addresses on the memory 111.

The end control circuit 701 issues an end-detection signal 731 representing the value "0", if it is judged that the tone data occupies an even number addresses on the memory 111. On the other hand, an end-detection signal 731 representing the value "1" is issued if it is judged that the tone data occupies an odd number addresses on the memory 111.

<Operations>

The following describes operations performed by the tone output device 700 having the above structure for the data control circuit 602 to output buffered tone data.

Note that the same operations as those described in the embodiment 1 are performed for the data control circuit 602 to store tone data fed to the data bus 110 into the buffer area. Thus, a description thereof is omitted.

In the description below, the following are supposed. That is, the width of the data bus 110 is 16 bits. The size of tone data that the data control circuit 602 stores at a time is 16 bits. The one address size of the memory 111 is one byte. The size of a desired piece of tone data is 40 bits. The data control circuit 602 sequentially outputs the buffered tone data one byte by one byte.

In addition, the 40-bit tone data is stored in one-byte units at the addresses from "01" to "05" on the memory 111. At the address "06" on the memory 111, a control program is stored.

In addition, the CPU 105 makes the following setting to the end control circuit 701 in advance. That is, the size of tone data that data control circuit 602 stores at a time is 16 bits, and the size of the desired piece of tone data is 40 bits.

<Output of Tone Data Stored Through $1^{st}$ and $2^{nd}$ Storing Processes>

First of all, the following describes operations performed by the data control circuit 602 to output, to the fetch number variable circuit 113, portions of the tone data that are stored through the $1^{st}$ and $2^{nd}$ storing processes.

At the time when the CPU 105 makes the size setting mentioned above, the end control circuit 701 divides the size of the desired piece of tone data (40 bits) by the size of tone data that data control circuit 602 stores at a time (16 bits), thereby to calculate the remainder. In this case, the reminder is "8". Thus, the end control circuit 701 has already issued an end-detection signal 731 representing the value "1" to the data control circuit 602. With the value "1", the end-detection signal 731 indicates that the desired piece of tone data corresponds in size to an odd number addresses.

After storing a portion of the tone data located at the addresses "01" and "02" on the memory 111 into the buffer, the data control circuit 602 sequentially outputs the buffered tone data in one-byte units to the fetch number variable circuit 113. Each portion of the buffered data is output in sync with the timing signal 154 received from the timing control circuit 603.

In a similar manner, the data control circuit 602 buffers a portion of the tone data located at the addresses "03" and "04" on the memory 111 and sequentially outputs the buffered tone data.

<Output of Tone Data Stored Through $3^{rd}$ Storing Process>

Next, the following describes operations performed by the data control circuit 602 to output, to the fetch number variable circuit 113, a portion of the tone data that is stored through the $3^{rd}$ storing process.

After storing portions of the tone data located on the memory 111 at the address "05" and the control program located at the address "06", the data control circuit 602 outputs the first one byte of the buffered data (a portion of the tone data located at the address "03") to the fetch number variable circuit 113, The output is made in sync with the timing signal 154 received from the timing control circuit 603.

Since the end-detection signal 731 having been received from the end control circuit 701 indicates "1", the data control circuit 602 outputs no further tone data to the fetch number variable circuit 113.

As described above, the tone output device 700 according to the modification 4 includes the end control circuit 701 that is not provided with a counter. Yet, similarly to the above embodiment, an effect is achieved that the data control circuit 602 does not output a control program remaining in the buffer.

Embodiment 4

<Overview>

The tone output device 100 according to the embodiment 1 outputs a tone signal converted from tone data that is stored in advance into the memory 111. It is therefore impossible to output a tone signal converted from tone data exceeding in size the capacity of the memory 111.

According to an embodiment 4 of the present invention, a tone output device reads tone data from a source external to the tone output device and stores the read tone data into the memory to output a tone signal. With this structure, the tone output device is enabled to output a tone signal converted from large-sized tone data exceeding the memory capacity.

<Structure>

Figure 13:
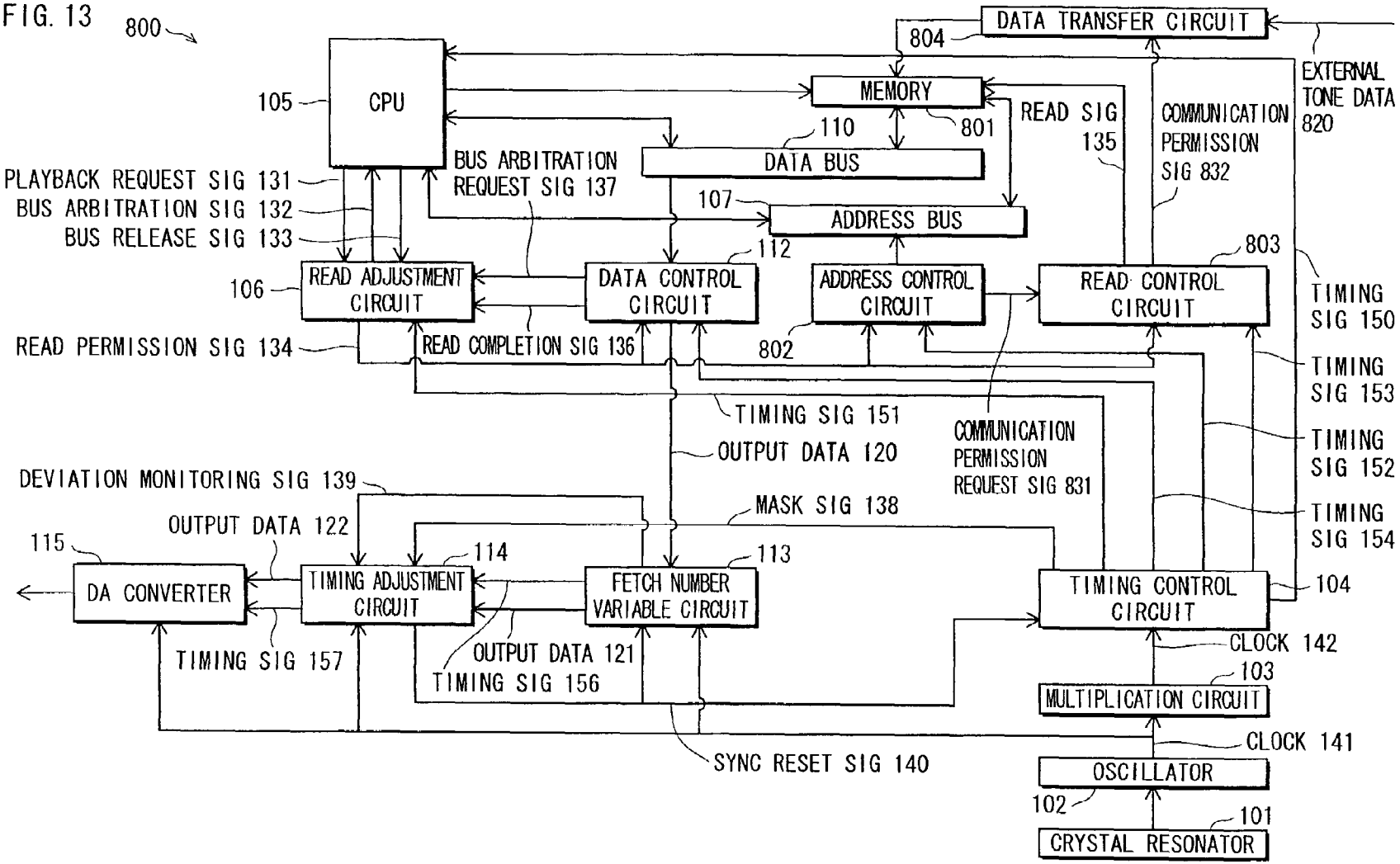
FIG. 13 is a block diagram of a tone output device 800 according to an embodiment 4 of the present invention.

FIG. 13 is a block diagram of a tone output device 800 according to the embodiment 4.

As illustrated in the figure, the tone output device 800 is composed of a crystal resonator 101, an oscillator 102, a multiplication circuit 103, a timing control circuit 104, a CPU 105, a read adjustment circuit 106, an address bus 107, a data bus 110, a data control circuit 112, a fetch number variable circuit 113, a timing adjustment circuit 114, a DA converter 115, a memory 801, an address control circuit 802, a read control circuit 803, and a data transfer circuit 804.

All the components other than the memory 801, the address control circuit 802, the read control circuit 803, and the data transfer circuit 804 are identical to the corresponding components of the embodiment 1. Thus, no description thereof is given.

The memory 801 is basically identical to the memory 111 according to the embodiment 1. The difference with the memory 111 lies in that the memory 801 has a specific area into which the data transfer circuit 804 stores external tone data 820, which will be described later.

The address control circuit 802 is basically identical to the address control circuit 108 according to the embodiment 1, but differs in the following respect. The CPU 105 sets in advance the start and end addresses of an area on the memory 801 into the internal register of the address control circuit 802. The memory area is used for storing tone data. The address control circuit 802 sequentially outputs the address values from the start address to the end address one by one. After outputting the end address, the address control circuit 802 repeats the sequential output of the address values from the start address.

Another difference with the address control circuit 108 lies in that the address control circuit 802 issues a communication request signal 831 to the read control circuit 803 upon outputting a predetermined address, such as an address that is one address before the end address. The communication request signal 831 requests a later-described communication permission signal 832 to be issued.

The read control circuit 803 is basically identical to the read control circuit 109 according to the embodiment 1. The difference with the read control circuit 109 lies in that the read control circuit 803 issues a communication permission signal 832 upon receipt of a communication request signal 831 from the address control circuit 802. The communication permission signal 832 instructs the data transfer circuit 804 to store later-described external tone data 820 into the memory 801.

Upon receipt of a communication permission signal 832 from the read control circuit 803, the data transfer circuit 804 stores, into its internal buffer, the external tone data 820 received from a device that is external to the tone output device 800 in sync with the external device. The external device is, for example, a CD-ROM drive and hereinafter, simply referred to as the "external device". The data transfer circuit 804 then sequentially transfers the buffered external tone data 820 portion by portion into the area on the memory 801 specified by the start and end addresses that have been set in the internal register of the memory 801 by the CPU 105.

As a result of the sequential transfer of the external tone data 820 by the data transfer circuit 804, the external tone data 820 are stored portion by portion at each of the addresses from the start and end addressee on the memory. When storing a portion of external tone data 820 at the end address, the data transfer circuit 804 suspends the storing process. The data transfer circuit 804 resumes the storing process upon receipt of another communication permission signal 832 from the read control circuit 803 and repeats the above operations. As a result, so that subsequent portions of the external tone data 820 is sequentially stored at the start to end addresses on the memory 801.

Note that the data transfer circuit 804 is under ordinal flow control, so that it is prohibited that an area of the memory 801 is overwritten with another portion of the external tone data 820, if tone data stored in that memory area is not yet read by the data control circuit 112.

<Operations>

The following describes operations performed by the tone output device 800 having the above described structure for storing external tone data 820 into the memory 801 and reading the external tone data 820 from the memory 801.

In the following description, it is supposed that the address control circuit 802 issues a communication request signal 831 upon outputting the address value that is one address before the end address.

Note that no description is given of the operations performed for arbitration of the bus-use right, since the operations are identical to those described in the embodiment 1.

<$1^{st}$ Storing Process of External Tone Data 820>

At a request for tone data playback, the CPU 105 sets the start and end addresses of a specific area of the memory 801 into the address control circuit 802 and the data transfer circuit 804.

When the start and end addresses on the memory 801 are set by the CPU 105, the data transfer circuit 804 stores external tone data 820 received from an external device into the buffer. The data transfer circuit 804 then sequentially transfers the buffered external tone data 820 portion by portion on the memory 801 starting from the start address. After storing a portion of the buffered external tone data 820 at the end address, the data transfer circuit 804 suspends the storing process.

<$1^{st}$ Reading Process of Tone Data>

Similar operations to those described in the embodiment 1 are performed to read tone data, until the address control circuit 802 outputs the address value that is one address before the end address to the address bus 103.

When the address control circuit 802 outputs the address value that is one address before the end address to the address bus 103, the address control circuit 802 issues a communication request signal 831 to the read control circuit 803.

Upon receipt of the communication request signal 831, the read control circuit 803 issues a communication permission signal 832 to the data transfer circuit 804.

The address control circuit 802 outputs the end address, so that tone data is read in the similar manner to the embodiment 1.

<$2^{nd}$ Storing Process of External Tone Data 820>

Upon receipt of a communication permission signal 832 from the read control circuit 803, the data transfer circuit 804 stores the newly received external tone data 820 portion by portion into the memory 801 from the start to end addresses, in a similar manner to the $1^{st}$ storing process of external tone data 820. After storing a portion of the buffered external tone data 820 at the end address, the data transfer circuit 804 suspends the storing process.

Thereafter, similarly to the $1^{st}$ reading process of tone data, the $2^{nd}$ portion of the tone data is read. By repeating the above processes, the tone output device 800 is enabled to continually play back any length of tone data that is received from the external device.

<Supplemental Note>

Up to this point, the tone output devices according to the present invention have been described by way of the above embodiments. It should be naturally appreciated, however, that the present invention is not limited to the tone output devices described in the specific embodiment above. Various other modifications including the following may be made without departing from the gist of the present invention.

(1) According to the embodiment 1, the fetch number variable circuit 113 repeatedly outputs a portion of tone data as output data 121 for the predetermined number of oversampling times. Yet, it is applicable to allow the number of oversampling times to be set to an appropriate value. Such a value may be determined based on the relation between the frequency of the clock 141 output by the oscillator 102 and the frequency of the clock 142 output by the multiplication circuit 103.

The specific setting value of the number of oversampling times will be described by way of the following example. In the example, the sampling frequency is 10 KHz, the number of oversampling times is 32 at default, the resolution of the DA converter is 12 bits, and the frequency of the clock 141 is 6 MHz. Further, the multiplication circuit 103 doubles the clock 141, so that the frequency of the clock 142 is 12 MHz.

First of all, the clock frequency necessary for operations of the DA converter 115 is calculated. The clock frequency for the DA converter 115 is calculated based on the sampling frequency, the default number of oversampling times, and the resolution of the DA converter, as mathematically expressed below.

$$10\ \text{KHz} \times 32\ \text{times} \times 12\ \text{bits} \approx 4\ \text{MHz}$$

In practice, however, the DA converter 115 receives the clock 141 of 6 MHz. In view of this, the fetch number variable circuit 159 needs to change the number of oversampling times from the default value of 32 to an appropriate value.

The appropriate number of oversampling times is calculated from the default number of oversampling times, the clock frequency that the DA converter receives, and the clock frequency necessary for the DA converter, as mathematically expressed below.

32 times×6 MHz/4 MHz=48 times (2) According to the embodiment 2, the data control circuit 402, a single buffer includes the buffer area for storing remaining data and the buffer area for storing tone data fed to the data bus 110. Alternatively, it is applicable to provide separate buffers for the respective purposes.

(3) According to the embodiment 3, the data control circuit 602 makes no further output after receiving an end-detection signal 632 from the end control circuit 601, even if some data still remains in the buffer without being output. Alternatively, it is applicable to output silent data irrespective of the actual values of remaining data.

(4) According to the embodiment 3, the width of the data bus 110 is different from the one address size of the memory 111. Yet, it is applicable that the width of the data bus 110 is equal to the one address size of the memory 111 (24 bits in the embodiment 3).

(5) According to the embodiment 4, the memory 801 may be either volatile or non-volatile memory, as long as such memory is capable of storing the external tone data 820. In the case of volatile memory, it is necessary to store control program etc. used by the CPU 105 into an external storage device, for example. If the data stored on the memory 801 is lost, necessary data is written back into the memory 801 from the external storage device.

(6) According to the embodiment 4, it is prevented under flow control that the data transfer circuit 804 overwrites an area of the memory 801 storing data not yet read by the data control circuit 112, with new external tone data 820. Alternatively, it is applicable to prevent such overwriting by providing two areas on the memory 801 for storing external tone data 820.

To be more specific, for example, the address control circuit 802 outputs the start address of one of the two areas. In response, the address control circuit 803 issues a communication request signal 831 to the read control circuit 803. Upon receipt of the communication request signal 831, the read control circuit 803 issues a communication permission signal 832 to the data transfer circuit 804.

Upon receipt of the communication permission signal 832, the data transfer circuit 804 stores external tone data 820 into the memory area that is different from the memory area corresponding to the address value fed by the address control circuit 802.

What is claimed is:

1. A tone output device that has internal memory storing tone data and a control program for reading of the tone data, and that reads and converts the tone data into an analog tone signal, the tone output device comprising:

a clock oscillator operable to generate a reference clock by using a crystal resonator;

a multiplication circuit operable to generate a multiplied clock by multiplying the reference clock;

a control circuit including an internal buffer and operable to store the tone data from the memory into the buffer and transfer the tone data stored in the buffer, the tone data storing being performed in sync with a signal based on the multiplied clock and the tone data transfer being performed in accordance with predetermined timing;

a CPU operable, in sync with a signal based on the multiplied clock, to execute the control program stored in the memory so as to cause the control circuit to perform the tone data transfer;

a DA converter operable, in sync with a clock signal based on the reference clock, to convert the transferred tone data into an analog tone signal and output the analog tone signal, and a data bus that is connected to the memory, the control circuit, and the CPU, and via which the tone data is transferred to the control circuit and the control program is transferred to the CPU, wherein the control by the CPU includes arbitration of a right to use the data bus, wherein the control circuit includes:

a read adjustment circuit operable, under control by the CPU, to issue a read permission signal upon being granted the right to use the data bus;

an output instruction circuit operable to perform an output instruction process upon receipt of a read permission signal, the output instruction process including outputting of an address on the memory at which the tone data is stored and of a read signal that instructs output of the tone data stored at the address; and a data control circuit operable, upon receipt of a read permission signal, to (i) perform a storing process of storing the tone data that is output to the data bus into the buffer and (ii) transfer the tone data stored in the buffer to the DA converter, and wherein upon receipt of the read signal from the output instruction circuit, the memory is operable to output the tone data stored at the address to the data bus;

wherein the tone data is composed of a plurality of pieces of sampling data each of which is compressed at a predetermined compression rate, wherein the buffer included in the data control circuit is composed of a first buffer area for storing the tone data that is output from the data bus and a second buffer area for saving tone data, the tone output device being operable to (i) store a size of each piece of compressed sampling data and (ii) issue a compression rate signal indicative of the data size to the data control circuit, wherein the data control circuit is operable to transfer, sequentially in units of the data size indicated by the compression rate signal, the tone data stored in the first buffer area, and wherein if tone data smaller than the data size indicated by the compression rate signal remains in the first buffer area as a result of the tone data transfer, the data control circuit is operable to (i) store the remaining tone data into the second buffer area and (ii) transfer the remaining tone data with a portion of tone data newly stored into the first buffer area, the remaining tone data and the portion of newly stored data amounting to the data size indicated by the compression rate signal.

2. A tone output device that has internal memory storing tone data and a control program for reading of the tone data, and that reads and converts the tone data into an analog tone signal, the tone output device comprising:

a clock oscillator operable to generate a reference clock by using a crystal resonator;

a multiplication circuit operable to generate a multiplied clock by multiplying the reference clock;

a control circuit including an internal buffer and operable to store the tone data from the memory into the buffer and transfer the tone data stored in the buffer, the tone data storing being performed in sync with a signal based on the multiplied clock and the tone data transfer being performed in accordance with predetermined timing;

a CPU operable, in sync with a signal based on the multiplied clock, to execute the control program stored in the memory so as to cause the control circuit to perform the tone data transfer;

a DA converter operable, in sync with a clock signal based on the reference clock, to convert the transferred tone data into an analog tone signal and output the analog tone signal, and a data bus that is connected to the memory, the control circuit, and the CPU, and via which the tone data is transferred to the control circuit and the control program is transferred to the CPU, wherein the control by the CPU includes arbitration of a right to use the data bus, wherein the control circuit includes:

a read adjustment circuit operable, under control by the CPU, to issue a read permission signal upon being granted the right to use the data bus;

an output instruction circuit operable to perform an output instruction process upon receipt of a read permission signal, the output instruction process including outputting of an address on the memory at which the tone data is stored and of a read signal that instructs output of the tone data stored at the address; and a data control circuit operable, upon receipt of a read permission signal, to (i) perform a storing process of storing the tone data that is output to the data bus into the buffer and (ii) transfer the tone data stored in the buffer to the DA converter, and wherein upon receipt of the read signal from the output instruction circuit, the memory is operable to output the tone data stored at the address to the data bus;

wherein the tone data is composed of a plurality of pieces of phrase data that are compressed at different compression rates, each piece of phrase data being composed of a plurality of pieces of sampling data, the tone output device being operable to (i) store, for each piece of phrase data, a size of each piece of compressed sampling data included in the respective piece of phrase data, and (ii) issue a compression rate signal indicative of the data size for a piece of phrase data that is currently stored in the buffer to the data control circuit, and wherein the data control circuit is operable to transfer, sequentially in units of the data size indicated by the compression rate signal, the phrase data stored in the buffer.

3. A tone output device that has internal memory storing tone data and a control program for reading of the tone data, and that reads and converts the tone data into an analog tone signal, the tone output device comprising:

a clock oscillator operable to generate a reference clock by using a crystal resonator;

a multiplication circuit operable to generate a multiplied clock by multiplying the reference clock;

a control circuit including an internal buffer and operable to store the tone data from the memory into the buffer and transfer the tone data stored in the buffer, the tone data storing being performed in sync with a signal based on the multiplied clock and the tone data transfer being performed in accordance with predetermined timing;

a CPU operable, in sync with a signal based on the multiplied clock, to execute the control program stored in the memory so as to cause the control circuit to perform the tone data transfer;

a DA converter operable, in sync with a clock signal based on the reference clock, to convert the transferred tone data into an analog tone signal and output the analog tone signal, and a data bus that is connected to the memory, the control circuit, and the CPU, and via which the tone data is transferred to the control circuit and the control program is transferred to the CPU, wherein the control by the CPU includes arbitration of a right to use the data bus, wherein the control circuit includes:

a read adjustment circuit operable, under control by the CPU, to issue a read permission signal upon being granted the right to use the data bus;

an output instruction circuit operable to perform an output instruction process upon receipt of a read permission signal, the output instruction process including outputting of an address on the memory at which the tone data is stored and of a read signal that instructs output of the tone data stored at the address; and a data control circuit operable, upon receipt of a read permission signal, to (i) perform a storing process of storing the tone data that is output to the data bus into the buffer and (ii) transfer the tone data stored in the buffer to the DA converter, and wherein upon receipt of the read signal from the output instruction circuit, the memory is operable to output the tone data stored at the address to the data bus;

wherein a size of tone data that the buffer included in the data control circuit stores at a time is equal to a size of an area of the memory corresponding to two addresses, the tone output device further comprising:

an end control circuit operable to (i) store a size of the tone data and the two-address memory size, (ii) divide the tone data size by the two-address memory size, and (iii) issue an end detection signal to the data control circuit when a remainder of the division is not equal to zero, and wherein upon receipt of an end detection signal, the data control circuit is operable to output tone data that is most recently stored into the buffer and that has a size of an area of the memory corresponding to one address.

4. A tone output device that has internal memory storing tone data and a control program for reading of the tone data, and that reads and converts the tone data into an analog tone signal, the tone output device comprising:

a clock oscillator operable to generate a reference clock by using a crystal resonator;

a multiplication circuit operable to generate a multiplied clock by multiplying the reference clock;

a control circuit including an internal buffer and operable to store the tone data from the memory into the buffer and transfer the tone data stored in the buffer;

a CPU operable to execute the control program stored in the memory so as to cause the control circuit to perform the tone data transfer; and a DA converter operable to convert the transferred tone data into an analog tone signal and output the analog tone signal, wherein the control circuit includes a transfer timing adjustment circuit operable to generate a timing signal based on the reference clock to transfer the tone data in sync with the timing signal;

the tone output device further operable to issue a reset signal upon detecting that a predetermined reference point of the multiplied clock deviates from a predetermined reference point of the reference clock by a predetermined amount, the reset signal being indicative of the deviation detection, and wherein upon receipt of a reset timing, the transfer timing adjustment circuit is operable to adjust generation of the timing signal so as to provide a predetermined relation between the timing signal and the timing with which the control circuit stores the tone data into the buffer.

* * * * *